US010838328B2

(12) United States Patent
Uchiyama

(10) Patent No.: US 10,838,328 B2
(45) Date of Patent: Nov. 17, 2020

(54) IMAGE FORMING APPARATUS THAT CONTROLS A SETTING USED FOR TEMPERATURE CONTROL BASED ON THERMAL HISTORY INFORMATION

(71) Applicant: CANON KABUSHIKI KAISHA, Tokyo (JP)

(72) Inventor: Takahiro Uchiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/411,723

(22) Filed: May 14, 2019

(65) Prior Publication Data

US 2019/0354047 A1 Nov. 21, 2019

(30) Foreign Application Priority Data

May 18, 2018 (JP) ..... 2018-096656

(51) Int. Cl.
*G03G 15/20* (2006.01)

(52) U.S. Cl.
CPC ..... *G03G 15/2039* (2013.01)

(58) Field of Classification Search
USPC ..... 399/69
See application file for complete search history.

(56) References Cited

U.S. PATENT DOCUMENTS

| | | | | |
|---|---|---|---|---|
| 9,091,974 | B2 | 7/2015 | Yoshioka et al. | |
| 9,377,727 | B2 | 6/2016 | Yoshioka et al. | |
| 9,568,867 | B2 | 2/2017 | Yoshioka et al. | |
| 9,989,900 | B2 | 6/2018 | Yoshioka et al. | |
| 10,054,882 | B2 | 8/2018 | Nomura et al. | |
| 2011/0142472 | A1* | 6/2011 | Mitsuoka | G03G 15/2039 399/69 |
| 2018/0210380 | A1 | 7/2018 | Uchiyama et al. | |
| 2018/0267442 | A1 | 9/2018 | Yoshioka et al. | |
| 2018/0341202 | A1 | 11/2018 | Nomura et al. | |
| 2019/0324389 | A1* | 10/2019 | Jota | G03G 15/2039 |

FOREIGN PATENT DOCUMENTS

| | | | |
|---|---|---|---|
| JP | H06-95540 | A | 4/1994 |
| JP | 2013-041118 | A | 2/2013 |
| JP | 2014-153505 | A | 8/2014 |
| JP | 2014-153506 | A | 8/2014 |
| JP | 2018-004943 | A | 1/2018 |

* cited by examiner

*Primary Examiner* — Quana Grainger
(74) *Attorney, Agent, or Firm* — Venable LLP

(57) ABSTRACT

Provided is an image forming apparatus, having: a fixing portion which includes a plurality of heating elements and heats a plurality of heating regions independently using the plurality of heating elements respectively so as to fix an image formed on a recording material to the recording material; an acquiring portion which acquires information on an image formed on a recording material, and thermal history information on a plurality of regions corresponding to the plurality of heating regions in the fixing portion respectively; and a control portion which controls heating of the heating regions by the fixing portion. The control portion corrects a control setting used for the temperature control of the heating regions, based on the thermal history information on a region of the fixing portion corresponding to a thermal history calculating region generated by dividing each of the heating regions in a direction orthogonal to the transport direction.

6 Claims, 18 Drawing Sheets

FIG.7A

| $D_{MAX}$ (n)(%) | FTn(℃) |
|---|---|
| 200≦$D_{MAX}$≦230 | 205 |
| 170≦$D_{MAX}$<200 | 202 |
| 140≦$D_{MAX}$<170 | 199 |
| 100≦$D_{MAX}$<140 | 196 |
| 0<$D_{MAX}$<100 | 193 |

FIG.7B

| TGT(℃) | TC |
|---|---|
| 200<TGT≦205 | 1.1 |
| 195<TGT≦200 | 1.0 |
| 190<TGT≦195 | 0.9 |
| 100<TGT≦190 | 0.7 |
| TGT=100 | 0.4 |

FIG.7C

| HL(mm) | HLC |
|---|---|
| HL≦50 | 1 |
| 50<HL≦100 | 2 |
| 100<HL≦150 | 3 |
| 150<HL≦200 | 4 |
| 200<HL≦250 | 5 |
| 250<HL≦300 | 6 |
| 300<HL≦400 | 7 |
| 400<HL | 8 |

FIG.7D

| | |
|---|---|
| STARTUP COUNT | WUC=2.0 |
| PRINT INTERVAL COUNT | INC=0.5 |
| POST-ROTATION COUNT | PC=1.0 |
| RECORDING MATERIAL PAPER PASSING COUNT | RMC=0.4 |
| HEAT RADIATION COUNT | DC=0.1 |

FIG.7E

| PL(mm) | PLC |
|---|---|
| PL≦50 | 1 |
| 50<PL≦100 | 2 |
| 100<PL≦150 | 3 |
| 150<PL≦200 | 4 |
| 200<PL≦250 | 5 |
| 250<PL≦300 | 6 |
| 300<PL≦400 | 7 |
| 400<PL | 8 |

FIG.7F

| HRV | VA |
|---|---|
| 20≦HRV<50 | -2 |
| 50≦HRV<100 | -5 |
| 100≦HRV<150 | -10 |
| 150≦HRV<200 | -15 |
| 200≦HRV | -20 |

FIG.10A

| THERMAL HISTORY CALCULATING REGION | | $CA_1$ | $CA_2$ | $CA_3$ | $CA_4$ | $CA_5$ | $CA_6$ | $CA_7$ | $CA_8$ | $CA_9$ | $CA_{10}$ | $CA_{11}$ | $CA_{12}$ | $CA_{13}$ | $CA_{14}$ |
|---|---|---|---|---|---|---|---|---|---|---|---|---|---|---|---|
| IMAGE HEATING PORTION | $D_{max}$ (%) | 0 | 40 | 40 | 40 | 40 | 40 | 40 | 40 | 40 | 0 | 0 | 0 | 0 | 0 |
| | FT(°C) | — | 193 | 193 | 193 | 193 | 193 | 193 | 193 | 193 | — | — | — | — | — |
| NON-IMAGE HEATING PORTION | PT(°C) | — | — | — | — | — | — | — | — | — | 120 | 120 | 120 | 120 | — |
| PAPER UNPASSING PORTION | NT(°C) | 110 | — | — | — | — | — | — | — | — | — | — | — | — | 110 |
| REGION HEAT ACCUMULATION AMOUNT | HRV | 241 | 165 | 141 | 141 | 141 | 141 | 141 | 141 | 138 | 125 | 122 | 122 | 146 | 225 |
| REGION CONTROL TARGET TEMPERATURE | TGT(PR) | — | 178 | 183 | 183 | 183 | 183 | 183 | 183 | 183 | — | — | — | — | — |
| | TGT(PP) | — | — | — | — | — | — | — | — | — | 120 | 120 | 120 | 120 | — |
| | TGT(NP) | 110 | — | — | — | — | — | — | — | — | — | — | — | — | 110 |

| HEATING REGION | | $A_1$ | $A_2$ | $A_3$ | $A_4$ | $A_5$ | $A_6$ | $A_7$ |
|---|---|---|---|---|---|---|---|---|
| CONTROL TARGET TEMPERATURE | TGT(A) | 178 | 183 | 183 | 183 | 183 | 120 | 120 |

FIG.10B

| | HEATING REGION | $A_1$ | | $A_2$ | | $A_3$ | | $A_4$ | | $A_5$ | | $A_6$ | | $A_7$ | |
|---|---|---|---|---|---|---|---|---|---|---|---|---|---|---|---|
| EXAMPLE 1 | THERMAL HISTORY CALCULATING REGION | $CA_1$ | $CA_2$ | $CA_3$ | $CA_4$ | $CA_5$ | $CA_6$ | $CA_7$ | $CA_8$ | $CA_9$ | $CA_{10}$ | $CA_{11}$ | $CA_{12}$ | $CA_{13}$ | $CA_{14}$ |
| | REGION HEAT ACCUMULATION AMOUNT | 241 | 165 | 141 | 141 | 141 | 141 | 141 | 141 | 138 | 125 | 122 | 122 | 146 | 225 |
| | CONTROL TARGET TEMPERATURE | 178 | | 183 | | 183 | | 183 | | 183 | | 120 | | 120 | |
| COMPARATIVE EXAMPLE | REGION HEAT ACCUMULATION AMOUNT | 141 | | 141 | | 141 | | 141 | | 141 | | 122 | | 122 | |
| | CONTROL TARGET TEMPERATURE | 183 | | 183 | | 183 | | 183 | | 183 | | 120 | | 120 | |

FIG.13

| HRV | VN |
|---|---|
| 100≦HRV<150 | -2 |
| 150≦HRV<200 | -4 |
| 200≦HRV | -6 |

FIG.15A

| A5 SIZE PAPER | HEATING REGION | $A_1$ | | $A_2$ | | $A_3$ | | $A_4$ | | $A_5$ | | $A_6$ | | $A_7$ | |
|---|---|---|---|---|---|---|---|---|---|---|---|---|---|---|---|
| EXAMPLE 3 | THERMAL HISTORY CALCULATING REGION | $CA_1$ | $CA_2$ | $CA_3$ | $CA_4$ | $CA_5$ | $CA_6$ | $CA_7$ | $CA_8$ | $CA_9$ | $CA_{10}$ | $CA_{11}$ | $CA_{12}$ | $CA_{13}$ | $CA_{14}$ |
| | REGION HEAT ACCUMULATION AMOUNT | 70 | 89 | 120 | 105 | 101 | 101 | 101 | 101 | 101 | 101 | 105 | 120 | 89 | 70 |
| | CONTROL TARGET TEMPERATURE | 110 | | 183 | | 183 | | 183 | | 183 | | 183 | | 110 | |
| COMPARATIVE EXAMPLE | REGION HEAT ACCUMULATION AMOUNT | 82 | | 101 | | 101 | | 101 | | 101 | | 101 | | 82 | |
| | CONTROL TARGET TEMPERATURE | 110 | | 183 | | 183 | | 183 | | 183 | | 183 | | 110 | |

FIG.15B

| A6 SIZE PAPER | HEATING REGION | $A_1$ | | $A_2$ | | $A_3$ | | $A_4$ | | $A_5$ | | $A_6$ | | $A_7$ | |
|---|---|---|---|---|---|---|---|---|---|---|---|---|---|---|---|
| EXAMPLE 3 | THERMAL HISTORY CALCULATING REGION | $CA_1$ | $CA_2$ | $CA_3$ | $CA_4$ | $CA_5$ | $CA_6$ | $CA_7$ | $CA_8$ | $CA_9$ | $CA_{10}$ | $CA_{11}$ | $CA_{12}$ | $CA_{13}$ | $CA_{14}$ |
| | REGION HEAT ACCUMULATION AMOUNT | 84 | 99 | 170 | 155 | 109 | 100 | 100 | 100 | 100 | 109 | 155 | 170 | 99 | 84 |
| | CONTROL TARGET TEMPERATURE | 110 | | 178 | | 183 | | 183 | | 183 | | 178 | | 110 | |
| COMPARATIVE EXAMPLE | REGION HEAT ACCUMULATION AMOUNT | 84 | | 100 | | 100 | | 100 | | 100 | | 100 | | 84 | |
| | CONTROL TARGET TEMPERATURE | 110 | | 183 | | 183 | | 183 | | 183 | | 183 | | 110 | |

IMAGE FORMING APPARATUS THAT CONTROLS A SETTING USED FOR TEMPERATURE CONTROL BASED ON THERMAL HISTORY INFORMATION

BACKGROUND OF THE INVENTION

Field of the Invention

The present invention relates to a fixing unit installed in an image forming apparatus, such as a copier and a printer, utilizing an electrophotographic system or an electrostatic recording system, and an image heating apparatus, such as a gloss applying apparatus, that improves a gloss value of a toner image by reheating a fixed toner image on a recording material.

Description of the Related Art

In an image heating apparatus, a system to selectively heat an image portion formed on a recording material is proposed to meet demand to save power (Japanese Patent Application Publication No. H06-95540). In a heater of this type, a plurality of divided heating regions are set in a direction orthogonal to the feeding direction of the recording material, and a plurality of heating elements, which heat the heating regions respectively, are disposed in the direction orthogonal to the feeding direction. Then, based on the image information on an image that is formed in each heating region, an image portion is selectively heated by a corresponding heating element. If a method of saving power by adjusting the heating conditions in accordance with the image information (Japanese Patent Application Publication No. 2013-41118) is combined with the above method, then further power saving becomes possible. Moreover, if the heating condition correction, in accordance with the thermal history of the image heating apparatus, is applied to each heating region, further power saving can be implemented.

SUMMARY OF THE INVENTION

In the case of performing control to supply power to each heating element under optimum heating conditions for each image of each heating region, using the methods disclosed in Japanese Patent Application Publication No. H06-95540 and Japanese Patent Application Publication No. 2013-41118, power can be saved more than in the case of not performing selective heating for the image portion. However, if heating in accordance with an image formed within each heating region is continued in each heating region, a difference is generated in the warmup level (hereafter heat accumulation amount) in each portion of the image heating apparatus corresponding to each heating region. If heating conditions are set for each heating region without considering the heat accumulation amount, heat may not be supplied to an unfixed toner image on the recording material appropriately, and a defective image may be generated thereby. This state is not desirable in terms of power saving as well. A countermeasure is predicting a heat accumulation amount of each heating region based on the thermal history of each region in a constituting member of the image heating apparatus corresponding to each heating region, and correcting the heating conditions of each heating region in accordance with the heat accumulation amount.

However, in this constituting member, the heat accumulation amount of a region corresponding to one heating region is not determined by the thermal history of the region corresponding to this heating region alone. In other words, in the constituting member, the heat accumulation amount of a region corresponding to one heating region is also influenced by heat propagated from regions corresponding to adjacent heating regions, which means that this heat accumulation amount is influenced by the thermal history of the regions corresponding to the adjacent heating regions. Therefore, in some cases, the heat accumulation amount predicted for each heating region may be very different from the actual heat accumulation amount, and an accurate prediction may not always be acquired.

Further, when a recording material is fed in a state where dividing positions of the heating region do not match with the feeding position, a paper passing region and a paper unpassing region exist in a heating region where the edge of the recording material passes. Hence the heat accumulation amount in the paper passing region is not determined by the thermal history of the paper passing region alone, but is also influenced by the thermal history of the paper unpassing region.

Therefore, in some cases, the heat accumulation amount predicted for the paper passing region may be very different from the actual heat accumulation amount, and sufficient prediction accuracy may not always be acquired.

It is an object of the present invention to provide a technique by which the heat accumulation amount of a region corresponding to each heating region of the fixing portion can be predicted more accurately, and an even better power saving effect can be implemented.

To achieve the above object, an image forming apparatus according to the present invention includes:

a fixing portion which includes a plurality of heating elements disposed in a direction orthogonal to a transport direction of a recording material, and heats a plurality of heating regions independently by the plurality of heating elements respectively, so as to fix an image formed on a recording material to the recording material;

an acquiring portion which acquires (i) information on an image formed on a recording material, and (ii) thermal history information on a plurality of regions of a constituting member of the fixing portion, corresponding to the plurality of heating regions respectively; and a control portion which controls heating of the plurality of heating regions by the fixing portion such that each temperature of the plurality of heating regions is individually controlled, wherein each of the plurality of heating regions is divided in a direction orthogonal to the transport direction into a plurality of thermal history calculating region, and the acquiring portion acquires thermal history information on a region of the constituting member corresponding to the thermal history calculating region, wherein the control portion corrects a control setting used for a temperature control of the plurality of heating regions, based on the thermal history information on the region of the constituting member corresponding to the thermal history calculating region.

To achieve the above object, an image forming apparatus according to the present invention includes:

a fixing portion which includes a plurality of heating elements disposed in a direction orthogonal to a transport direction of a recording material, and heats a plurality of heating regions independently by the plurality of heating elements respectively, so as to fix an image formed on a recording material to the recording material;

an acquiring portion which acquires (i) information on an image formed on a recording material, and (ii) thermal history information on a plurality of regions of a constituting member of the fixing portion, corresponding to the plurality of heating regions respectively; and a control portion which controls each temperature of the plurality of heating regions independently, wherein each of the plurality of heating regions is divided in a direction orthogonal to the transport direction into a plurality of thermal history calculating region, and the acquiring portion acquires (iii) thermal history information of a region of the constituting member corresponding to the thermal history calculating region, and (iv) a ratio of a paper passing region and a paper unpassing region in the thermal history calculating region, wherein the control portion corrects a control setting used for the temperature control of the plurality of heating regions, based on (iii) the thermal information of a region of the constituting member corresponding to the thermal history calculating region, and (iv) the ratio of a paper passing region and a paper unpassing region in the thermal history calculating region.

According to the present invention, the heat accumulation amount of a region corresponding to each heating region of the fixing portion can be predicted more accurately, and an even better power saving effect can be implemented.

Further features of the present invention will become apparent from the following description of exemplary embodiments with reference to the attached drawings.

BRIEF DESCRIPTION OF THE DRAWINGS

FIG. 7A to FIG. 7F indicate parameters to determine the control temperature according to the example;

FIG. 10A and FIG. 10B indicate the results of comparison of experimental results between Example 1 and a comparative example;

FIG. 13 indicates parameters to determine the control temperature according to Example 2;

FIG. 15A and FIG. 15B indicate the results of comparison of experimental results between Example 3 and a comparative example;

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

1. Configuration of Image Forming Apparatus

Figure 1:
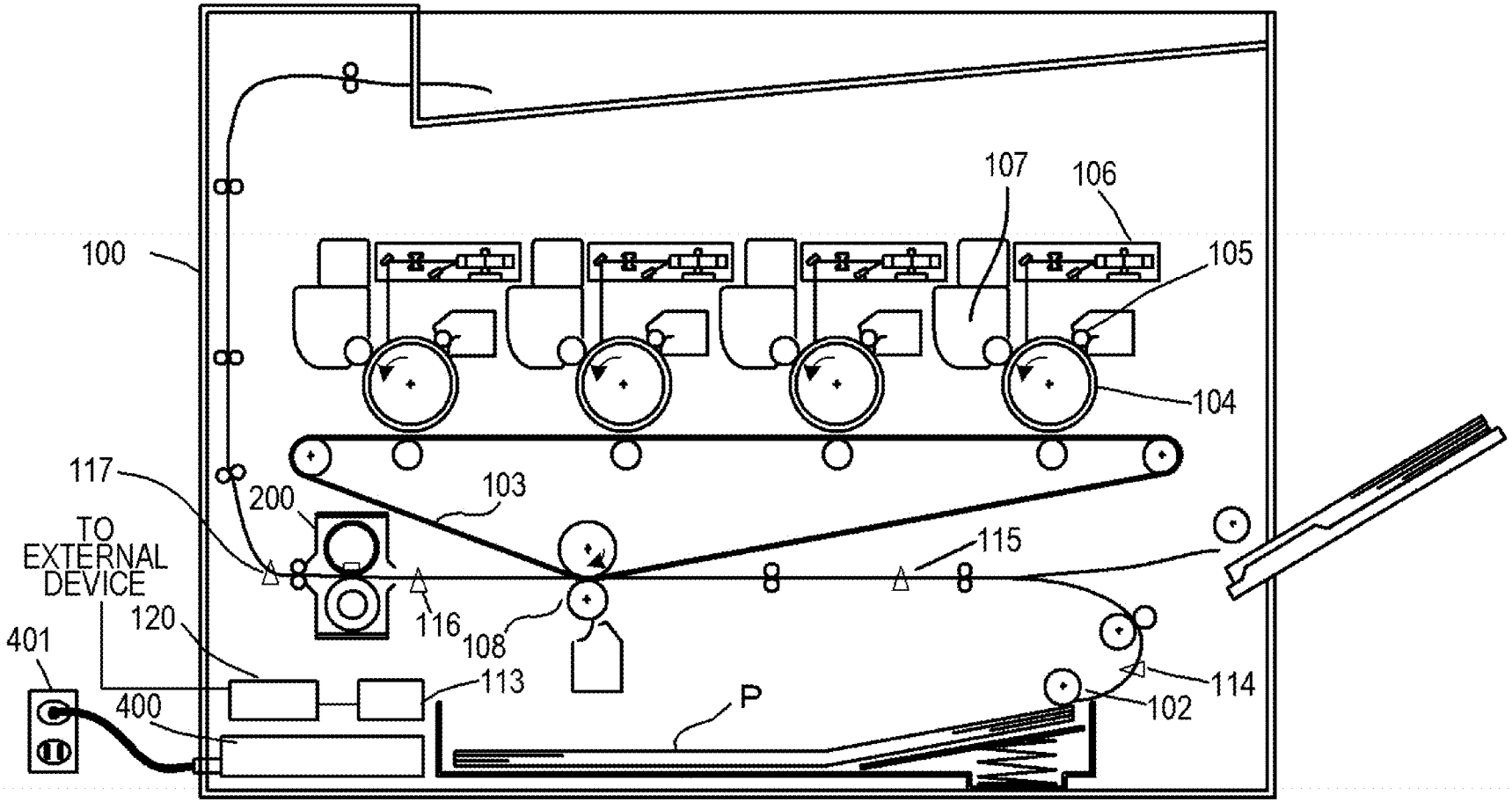
FIG. 1 is a cross-sectional view depicting an image forming apparatus of an example of the present invention.

FIG. 1 is a diagram depicting a configuration of an electrophotographic type image forming apparatus according to an example of the present invention. The present invention can be applied to such an image forming apparatus as an electrophotographic or electrostatic recording type copier and printer, and a case of applying the present invention to a laser printer will be described here.

An image forming apparatus 100 includes a video controller 120 and a control portion 113. The video controller 120 is an acquiring portion which acquires information on an image to be formed on a recording material, and receives and processes image information and print instructions which are sent from such an external device as a personal computer. The control portion 113 is connected with a video controller 120 and controls each portion constituting the image forming apparatus 100 in accordance with the instruction from the video controller 120. When the video controller 120 receives a print instruction from an external device, the image is formed according to the following operation.

The image forming apparatus 100 feeds a recording material P by a feeding roller 102 and transports the recording material P toward an intermediate transfer member 103. A photosensitive drum 104 is rotary-driven counterclockwise at a predetermined speed by the power of a drive motor (not illustrated), and is uniformly charged by a primary charging device 105 in this rotating process. The laser beam, which is modulated corresponding to the image signal, is outputted from the laser beam scanner 106, and selectively scans and eposes on the photosensitive drum 104 so as to form an electrostatic latent image. 107 indicates a developing device, and adheres powder toner (developer) to the electrostatic latent image so that the electrostatic latent image is made visible as a toner image (developer image). The toner image formed on the photosensitive drum 104 is primarily transferred to the intermediate transfer member 103, which rotates in contact with the photosensitive drum 104.

The photosensitive drum 104, the primary charging device 105, the laser beam scanner 106 and the developing device 107 are disposed for four colors (cyan (C), magenta (M), yellow (Y) and black (K)) respectively. Four colors of toner images are superimposed and transferred to the intermediate transfer member 103 sequentially according to the same procedures. The toner image transferred onto the intermediate transfer member 103 is secondarily transferred onto the recording material P by a transfer bias applied to the transfer roller 108, in a secondary transfer portion constituted by the intermediate transfer member 103 and a transfer roller 108. Then the fixing apparatus 200, which is a fixing portion (image heating portion), heats and presses the recording material P, whereby the toner image is fixed to the recording material P, and is discharged outside the apparatus as an image formed product.

The control portion 113 manages the transport state of the recording material P using a transport sensor 114, a resist sensor 115, a pre-fixing sensor 116, and a fixing discharging sensor 117, which are disposed on the transport path of the recording material P. In addition, the control portion 113 includes a storage portion which stores a temperature control program of the fixing apparatus 200 and a temperature control table. A control circuit 400, which is a heater driving unit connected to a commercial AC power supply 401, supplies power to the fixing apparatus 200.

2. Configuration of Fixing Apparatus (Fixing Portion)

Figure 2:
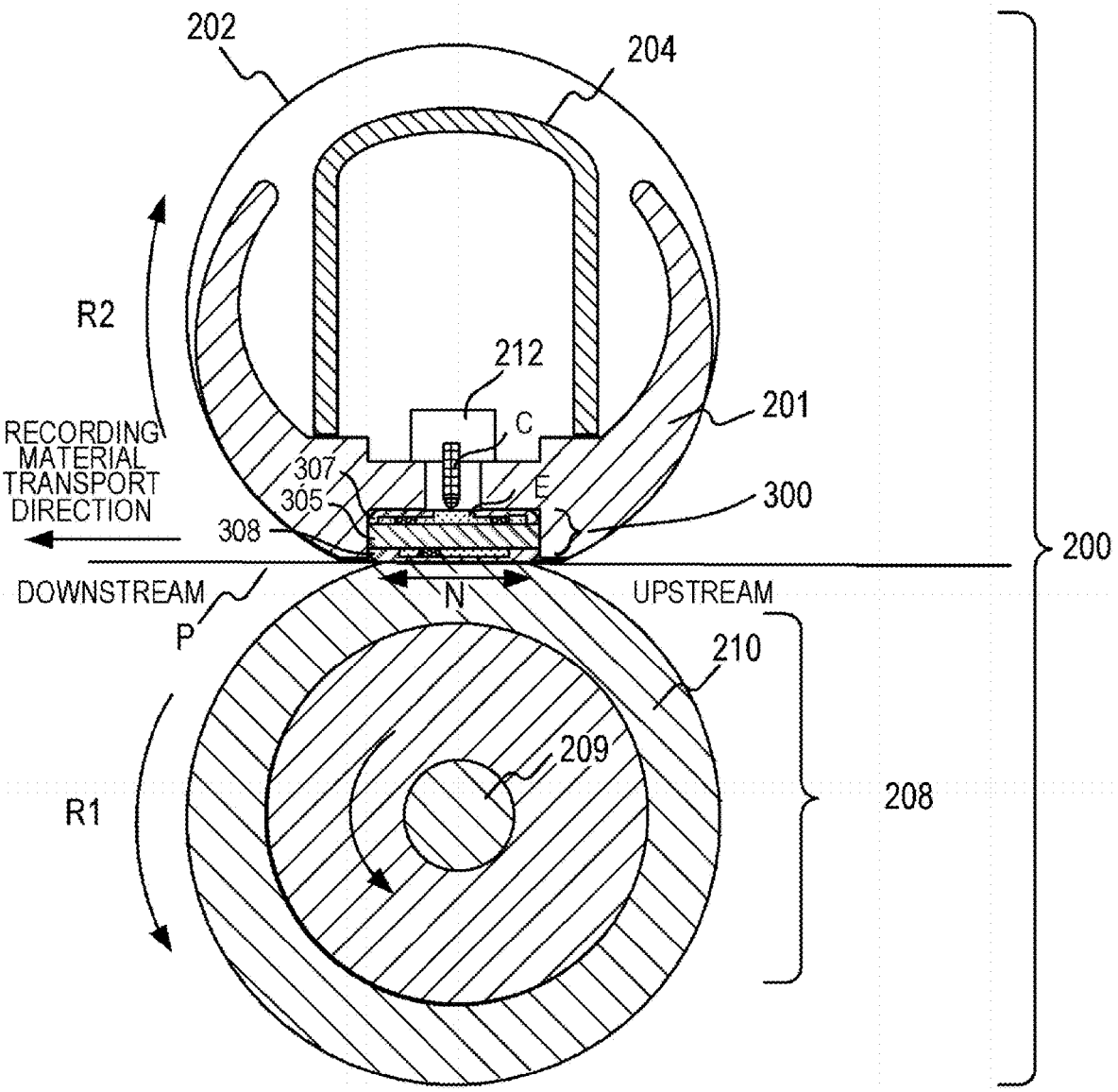
FIG. 2 is a cross-sectional view depicting a fixing apparatus of the example.

FIG. 2 is a schematic cross-sectional view of the fixing apparatus 200, which is an image heating apparatus of Example 1. The fixing apparatus 200 includes: a fixing film 202 (endless belt); a heater 300 which contacts the inner surface of the fixing film 202; and a pressure roller 208 (pressure member) which contacts the outer surface of the fixing film 202. The pressure roller 208 forms a fixing nip portion N with the heater 300 via the fixing film 202.

The fixing film 202 is a flexible multilayer heat resistant film formed in a tubular shape, and has a base layer made of a 50 to 100 μm thick heat resistant resin (e.g. polyimide) or a 20 to 50 μm thick metal (e.g. stainless steel). On the surface of the fixing film 202, a release layer is formed to prevent the attachment of toner and to ensure separation from the recording material P. The release layer is made of a heat resistant resin having good releasability, such as a 10 to 50 μm thick tetrafluoroethylene-perfluoroalkylvinylether copolymer (PFA). Further, in the case of a fixing film used for an apparatus that forms color images, a heat resistant rubber (e.g. silicon rubber), of which thickness is about 100 to 400 μm and thermal conductivity is about 0.2 to 3.0 W/m·K, may be disposed as an elastic layer between the base layer and the release layer in order to improve image quality. In Example 1, in terms of thermo-responsiveness image quality, durability and the like, a 60 μm thick polyimide is used for the base layer, a 300 μm thick silicon rubber, of which thermal conductivity is 1.6 W/m·K, is used for the elastic layer, and a 30 mm thick PFA is used for the release layer.

The pressure roller 208 includes a core metal 209 made of such material as iron and aluminum, and an elastic layer 210 made of such material as silicon rubber. A heater 300 is held in a heater holding member 201 made of heat-resistant resin, and heats the fixing film 202. The heater holding member 201 also has a guide function to guide the rotation of the fixing film 202. A metal stay 204 receives a pressing force from an energizing member (not illustrated), and energizes the heater holding member 201 toward the pressure roller 208. The pressure roller 208 receives power from a motor (not illustrated), and rotates in the arrow mark R1 direction. By the rotation of a pressure roller 208, the fixing film 202 follows and rotates in the arrow mark R2 direction. The fixing nip portion N holds and transports the recording material P while the heat of the fixing film 202 is transferred to the recording material P, whereby the unfixed toner image on the recording material P is fixed.

Figure 3A:
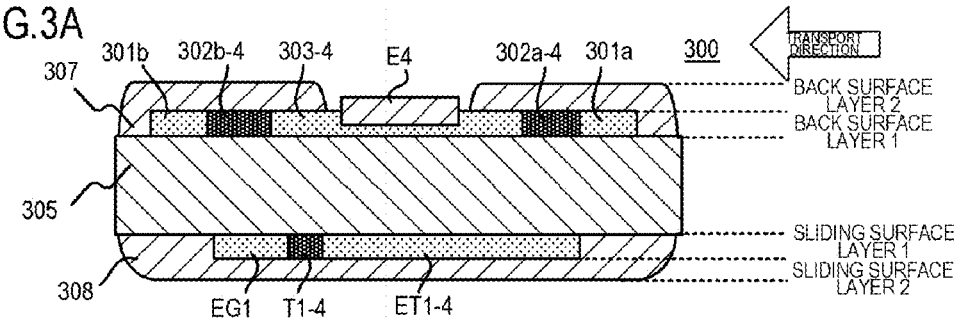
FIG. 3A to FIG. 3C indicate the heater configuration diagrams of the example.
Figure 3B:
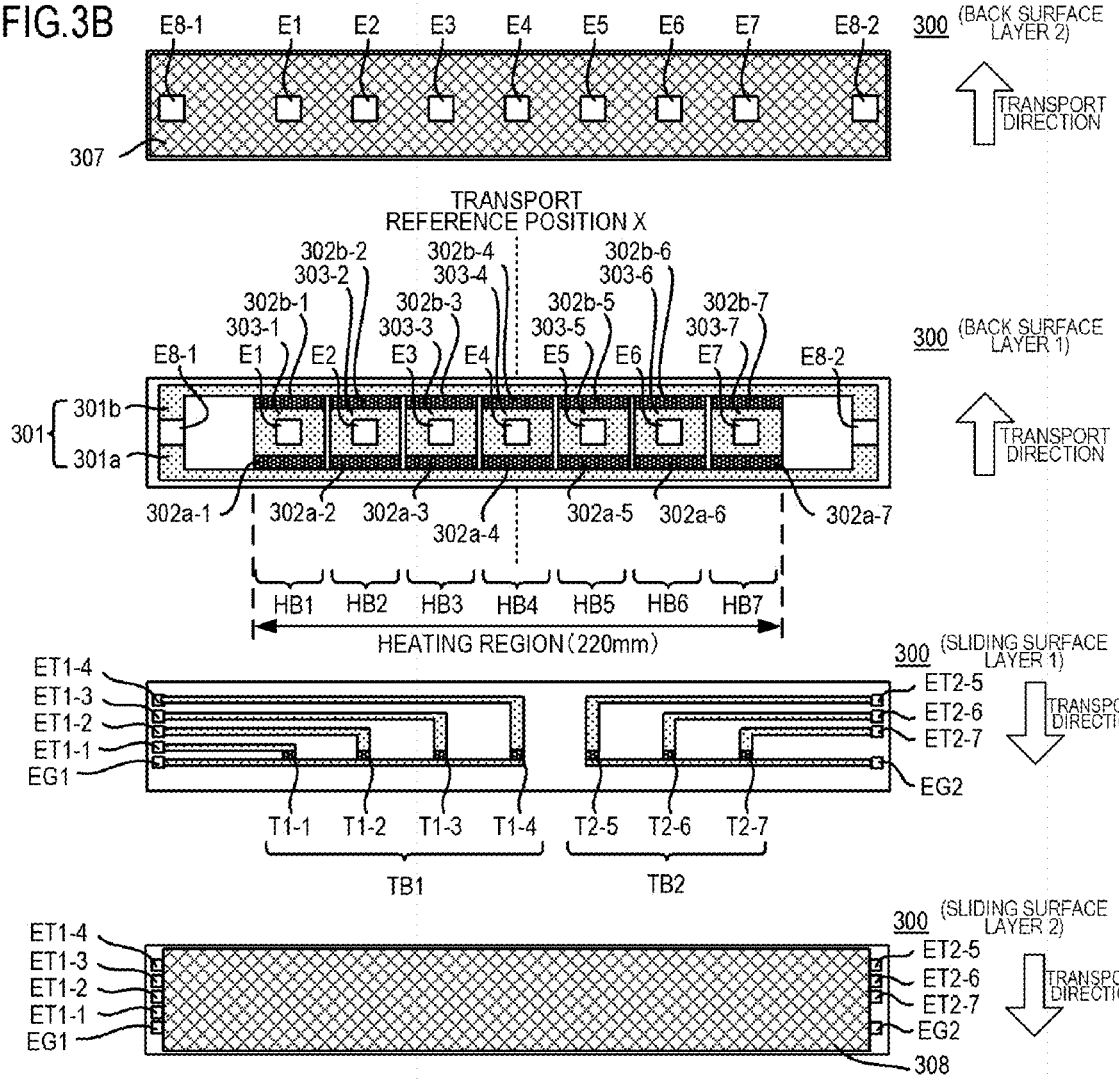
Figure 3C:
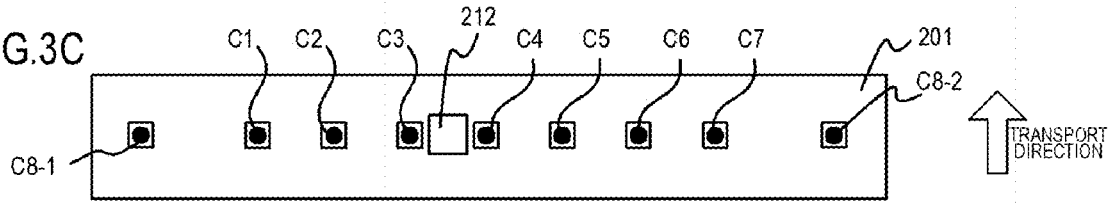

The heater 300 heats up when power is supplied to the heating resistor (heating element) disposed on a ceramic substrate 305. The heater 300 includes a surface protective layer 308 which contacts the inner surface of the fixing film 202 and a surface protective layer 307 which is disposed on the surface (back surface side), which is the opposite side of the side on which the surface protective layer 308 of the substrate 305 is disposed (sliding surface side). Electrodes for supplying power (electrode E4 in FIG. 3A to FIG. 3C is used for description here as an example) are disposed on the back surface side of the heater 300. C is an electric contact that contacts the electrode E, and power is supplied to the electrode E via this electric contact. The heater 300 will be described in detail later. A safety element 212, such as a thermo-switch and a temperature fuse, which is activated by an abnormal heating of the heater 300 and interrupts power to be supplied to the heater 300, is also disposed so as to face the back surface side of the heater 300.

3. Configuration of Heater

FIG. 3A to FIG. 3C indicate diagrams depicting the configuration of the heater 300 according to Example 1 of the present invention.

FIG. 3A is a cross-sectional view of the heater sectioned at around the transport reference position X indicated in FIG. 3B. The transport reference position X is defined as a reference position when a recording material P is transported. In the image forming apparatus of Example 1, a recording material is transported such that the center of the recording material P in the width direction, which is orthogonal to the transport direction, passes the transport reference position X. The heater 300 generally has a five layer structure: a substrate 305, two layers (back surface layer 1, 2) disposed on one side (back surface) of the substrate 305, and two layers (sliding surface layers 1, 2) disposed on the other side (sliding surface) of the substrate 305.

The heater 300 includes first conductors 301 (301*a*, 301*b*) which are disposed on the surface of the back surface layer side of the substrate 305 in the longer direction of the heater 300. The heater 300 also includes second conductors 303 (303-4 is disposed near the transport reference position X) which are disposed on the substrate 305 along the longer direction of the heater 300, at different positions from the first conductors 301 in the shorter direction (direction orthogonal to the longer direction) of the heater 300. The first conductors 301 are separated into the conductor 301*a*, which is disposed at the upstream side in the transport direction of the recording material P, and the conductor 301*b* which is disposed at the downstream side thereof. Further, the heater 300 includes heating resistors 302, which are disposed between the first conductors 301 and the second conductors 303, and generate heat by the power which is supplied via the first conductors 301 and the second conductors 303.

The heating resistors 302 are separated into the heating resistors 302*a* (302*a*-4 is disposed near the transport reference position X) which are disposed at the upstream side in the direction of the recording material P, and the heating resistors 302*b* (302*b*-4 is disposed near the transport reference position X) which are disposed at the downstream side thereof. On the back surface layer 2 of the heater 300, a surface protective layer 307 having an insulating property (glass in Example 1), which covers the heating resistors 302, the first conductors 301 and the second conductors 303, is disposed, excluding the areas of the electrode portion (E4 is disposed near the transport reference position X).

FIG. 3B indicates a plan view of each layer of the heater 300. On the back surface layer 1 of the heater 300, a plurality of heating blocks are disposed on the longer direction of the heater 300, and each heating block is constituted of a set of a first conductor 301, a second conductor 303, and a heating resistor 302. The heater 300 of Example 1 includes a total of seven heating blocks HB1 to HB7 which are disposed in the longer direction of the heater 300. The heating region is from the left edge of the heating block HB1 to the right edge of the heating block HB7, and is 220 mm long. In this example, the width in the longer direction of each heating block (width of each heating block in the direction along the longer direction of the heater 300) is all the same (the width of each heating block in the longer direction need not all be the same).

The heating blocks HB1 to HB7 are constituted by the heating resistors 302*a*-1 to 302*a*-7 and the heating resistors 302*b*-1 to 302*b*-7, which are disposed symmetrically with respect to the shorter direction of the heater 300 respectively. The first conductors 301 are constituted by the conductors 301*a* connected to the heating resistors (302*a*-1 to 302*a*-7), and the conductors 301*b* connected to the heating resistors (302*b*-1 to 302*b*-7) respectively. In the same manner, the second conductors 303 are divided into seven conductors 303-1 to 303-7 to support the seven heating blocks HB1 to HB7.

The electrodes E1 to E7, E8-1 and E8-2 are connected to electric contacts C1 to C7. The electrodes E1 to E7 are electrodes to supply power to the heating blocks HB1 to HB7 via the conductors 303-1 to 303-7 respectively. The electrodes E8-1 and E8-2 are common electrodes to supply power to the seven heating blocks HB1 to HB7 via the conductors 301*a* and 301*b* respectively. In Example 1, the electrodes E8-1 and E8-2 are disposed on both ends of the substrate (heater) in the longer direction, but only the electrode E8-1 may be disposed on one end (that is, the electrode E8-2 is not disposed), or the electrode E8-1 and the electrode E8-2 may be disposed separately in the transport direction of the recording material.

The surface protective layer 307 on the back surface layer 2 of the heater 300 is formed so that the electrodes E1 to E7, E8-1 and E8-2 are exposed. Thereby the electric contacts C1 to C7, C8-1 and C8-2 can be connected to each electrode from the side of the back surface layer of the heater 300. The heater 300 is configured to supply power from the back surface layer side. Further, the heater 300 is configured such that the power supplied to at least one of the heating blocks and power supplied to the other heating blocks can be independently controlled.

By disposing the electrodes on the back surface of the heater 300, the width of the substrate 305 in the shorter direction can be decreased, since wiring using conductive patterns on the substrate 305 is unnecessary. This results in a reduction of material cost of the substrate 305, and a decrease in the startup time to increase the temperature of the heater 300 by reducing the thermal capacity of the substrate 305. The electrodes E1 to E7 are disposed within a region of the substrate where the heating resistors are disposed in the longer direction.

In Example 1, a material having a characteristic whereby the resistance value increases as the temperature increases (hereafter called "PTC characteristic") is used for the heating resistors 302. By using the material having the PTC characteristic for the heating resistors, the resistance values of the heating resistors disposed in a paper unpassing portion, in the case of performing fixing processing for a small sized paper, become higher than that of the heating resistors disposed in a paper passing portion, and less current flows in the heating resistors in the paper unpassing portion. As a result, an effect to suppress the temperature rising in the paper unpassing portion can be enhanced. However, the material used for the heating resistors 302 is not limited to the material having the PTC characteristic, but may be a material having a characteristic whereby the resistance value decreases as the temperature increases (hereafter called "NTC characteristic"), or a material having a characteristic whereby the resistance value does not change, even if temperature changes.

On the sliding surface layer 1 on the side of the sliding surface of the heater 300 (surface on the side of contacting the fixing film), thermistors T1-1 to T1-4 and thermistors T2-5 to T2-7 are disposed to detect the temperature of the heating blocks HB1 to HB7 of the heater 300. The thermistors T1-1 to T1-4 and the thermistors T2-5 to T2-7 are created by thinly forming a material having the PTC characteristics or the NTC characteristic (NTC characteristic in the case of Example 1). Since all of the heating blocks HB1 to HB7 has an individual thermistor, the temperature of all the heating blocks HB1 to HB7 can be detected by detecting the resistance value of each thermistor.

In order to supply power to all four thermistors T1-1 to T1-4, conductors ET1-1 to ET1-4, for detecting the resistance values of the thermistors, and a common conductor EG1 of the thermistors are disposed. These conductors and the thermistors T1-1 to T1-4 constitute a thermistor block TB1. In the same manner, in order to supply power to the three thermistors T2-5 to T2-7, conductors ET2-5 to ET2-7 for detecting the resistance values of the thermistors, and common conductor EG2 of the thermistors, are disposed. These conductors and the thermistors T2-5 to T2-7 constitute a thermistor block TB2.

An effect of using the thermistor block TB1 will be described. First by disposing the common conductor EG1 of the thermistors, the cost of wiring the conductor patterns can be reduced compared with the case of connecting and wiring each conductor to the thermistors T1-1 to T1-4. Further, the width of the substrate 305 in the shorter direction can be decreased, since wiring using the conductive patterns on the substrate 305 is unnecessary. This results in reduction of material cost of the substrate 305, and decreases the startup time to increase the temperature of the heater 300 by reducing the thermal capacity of the substrate 305. An effect of using the thermistor block TB2 is the same as the case of the thermistor block TB1, hence description thereof is omitted.

In order to decrease the width of the substrate 305 in the shorter direction, it is effective to combine the configuration of the heating blocks HB1 to HB7 mentioned in the description on the back surface layer 1 in FIG. 3A, and the configuration of the thermistor blocks TB1 and TB2 mentioned in the description on the sliding surface layer 1 in FIG. 3A.

On the sliding surface layer 2 on the side of the sliding surface of the heater (surface on the side of contacting the inner surface of the fixing film), a surface protective layer 308 having a sliding property (glass in Example 1) is disposed. The surface protective layer 308 is formed excluding both ends on the heater 300, so as to connect each electric contact to the conductors ET1-1 to ET1-4, ET2-5 to ET2-7 for detecting the resistance values of the thermistors, and the common conductors EG1 and EG2 of the thermistors. The surface protective layer 308 is disposed on the surface facing the film 202 of the heater 300, at least in a region that slides with the film 202, excluding both ends.

As illustrated in FIG. 3C, on the surface of the heater holding member 201 that faces the heater 300, holes to connect electrodes E1 to E7, E8-1 and E8-2 and the electric contacts C1 to C7, C8-1 and C8-2 are formed. The above mentioned safety element 212, and the electric contacts C1 to C7, C8-1 and C8-2 are disposed between the stay 204 and the heater holding member 201. The electric contacts C1 to C7, C8-1 and C8-2, which contact the electrodes E1 to E7, E8-1 and E8-2, are electrically connected to each electrode portion of the heater respectively, by such a method as an energizing spring or welding. Each electric contact is connected to the later mentioned control circuit 400 of the heater 300 via a cable, or by such a conductive material as a thin metal plate, disposed between the stay 204 and the heater holding member 201. The electric contacts disposed at the conductors ET1-1 to ET1-4 and ET2-5 to ET2-7, for detecting the resistance values of the thermistors, and at the common conductors EG1 and EG2 of the thermistors, are also connected to the later mentioned control circuit 400.

4. Configuration of Heater Control Circuit

Figure 4:
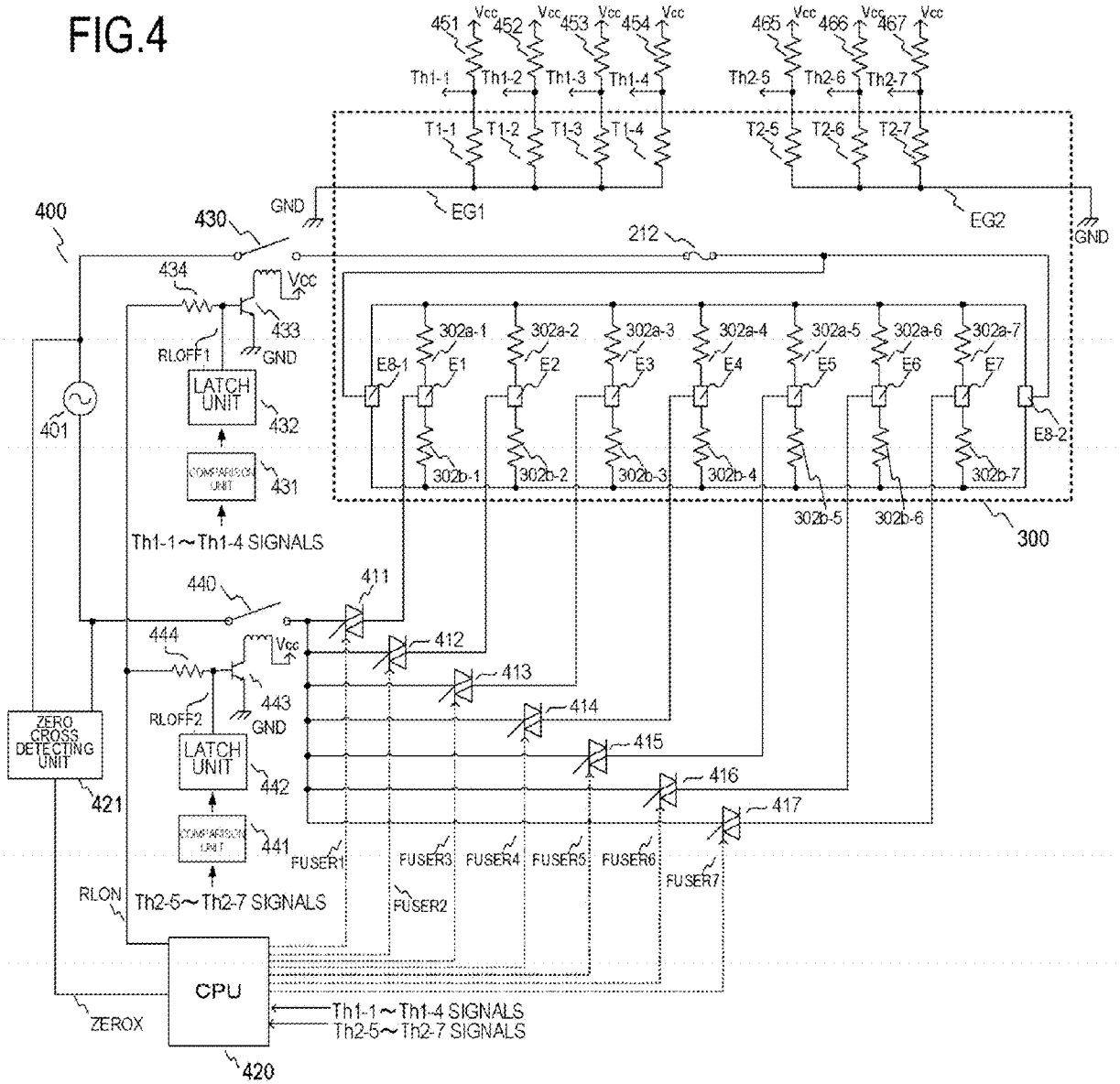
FIG. 4 is a heater control circuit diagram of the example.

FIG. 4 is a circuit diagram of the control circuit 400 of the heater 300 according to Example 1. A commercial AC power supply 401 is connected to the image forming apparatus 100. The power of the heater 300 is controlled by the ON/OFF of the triac 411 to triac 417. Each of the triacs 411 to 417 operates in accordance with the FUSER 1 to FUSER 7 signals from the CPU 420. The driving circuits of the triacs 411 to 417 are omitted in FIG. 4. The control circuit 400 of the heater 300 is configured such that the seven heating blocks HB1 to HB7 can be independently controlled by the seven triacs 411 to 417. A zero-cross detecting unit 421 is a circuit to detect the zero cross of the AC power supply 401, and outputs a ZEROX signal to the CPU 420. The ZEROX signal is used to detect the timings of the phase control and the wave number control of the triacs 411 to 417.

A temperature detection method of the heater 300 will be described. As the temperature detected by the thermistors T1-1 to T1-4 of the thermistor block TB1, the Th1-1 to Th1-4 signals, which are voltages divided between the thermistors T1-1 to T1-4 and resistors 451 to 454, is detected by the CPU 420. In the same manner, the temperature detected by the thermistors T2-5 to T2-7 of the thermistor block TB2 is detected by the CPU 420 as the Th2-5 to Th2-7 signals, which are voltages divided between the thermistors T2-5 to T2-7 and the resistors 465 to 467. In the internal processing of CPU 420, power to be supplied to the heater 300 is calculated based on the difference between the control target temperature of each heating block and the current detected temperature of each thermistor. For example, power to be supplied by the PI control is calculated. Further, the power to be supplied is converted into a control level of a phase angle (phase control) or a wave member (wave number control) corresponding to the power to be supplied, and the triacs 411 to 417 are controlled based on these control conditions. The CPU 420, which is a control portion and an acquiring portion of the present invention, executes various operations and electrification control related to the temperature control of the heater 300.

A relay 430 and a relay 440 are used as power interrupt units to interrupt power to the heater 300 when the heater 300 overheats due to a failure or the like. The circuit operation of the relay 430 and the relay 440 will be described. When an RLON signal becomes High, a transistor 433 turns ON, power is supplied from a power supply voltage Vcc to a secondary side coil of the relay 430, and a primary side contact of the relay 430 turns ON. When the RLON signal becomes Low, the transistor 433 turns OFF, the current supplied from the power supply voltage Vcc to the secondary side coil of the relay 430 is interrupted, and the primary side contact of the relay 430 turns OFF. In the same manner, when the RLON signal becomes High, a transistor 443 turns ON, power is supplied from the power supply voltage Vcc to a secondary side coil of the relay 440, and a primary side contact of the relay 440 turns ON. When the RLON signal becomes Low, the transistor 443 turns OFF, the current supplied from the power supply voltage Vcc to the secondary side coil of the relay 440 is interrupted, and the primary side contact of the relay 440 turns OFF. The resistor 434 and the resistor 444 are current limiting resistors.

An operation of a safety circuit using the relay 430 and the relay 440 will be described. When any one of the temperatures detected by the thermistors Th1-1 to Th1-4 exceeds a respective predetermined set value, a comparison unit 431 activates a latch unit 432, and the latch unit 432 latches an RLOFF1 signal in the Low state. When the RLOFF1 signal becomes Low, the transistor 433 is kept in the OFF state, even if the CPU 420 sets the RLON signal to High, hence the relay 430 is maintained in the OFF state (safe state). The latch unit 432 sets the RLOFF1 signal to open in the non-latch state. In the same manner, when any one of the temperatures detected by the thermistors Th2-5 to Th2-7 exceeds a respective predetermined set value, a comparison unit 441 activates a latch unit 442, and the latch unit 442 latches the RLOFF2 signal in the Low state. When the RLOFF2 signal becomes Low, the transistor 443 is kept in the OFF state, even if the CPU 420 sets the RLON signal to High, hence the relay 440 is maintained in the OFF state (safe state). The latch unit 442 also sets the RLOFF2 signal to open in the non-latch state.

5. Overview of Heater Control Method

The image forming apparatus of Example 1 optimally controls power to be supplied to the seven heating blocks HB1 to HB7 of the heater 300 respectively, in accordance with the image data (image information) sent from an external device (not illustrated), such as a host computer, so as to selectively heat an image portion. The power to be supplied to the heating blocks HB1 to HB7 respectively is determined based on the control temperature (hereafter called "control temperature TGT") used as the heating control parameter for each heating block HB1 TO HB7. Temperature control is performed so that each temperature of the heating blocks HB1 to HB7 detected by the thermistors T1-1 to T2-7 becomes the same as the control temperature TGT which is set for the heating blocks HB1 to HB7 respectively.

The control temperature TGT for an image formed on positions corresponding to the heating blocks HB1 to HB7 is determined depending on the kind of image that is formed and how much heat accumulates in a portion in the image heating apparatus corresponding to the image position. In Example 1, an intended value of the control temperature TGT (hereafter called "intended heating temperature FT") is determined based on the image data (image information), so that heating is performed at a higher temperature for an image having more toner amount. Further, the intended heating temperature FT is corrected in accordance with the heat accumulation amount of the image heating apparatus in a portion corresponding to the image position, whereby the control temperature TGT is determined. Example 1 has a configuration to predict the heat accumulation amount of the image heating apparatus based on the heating history and heating radiating history of the image heating apparatus, and a difference of Example 1 from prior art is a method of correcting the control temperature for control setting, based on the heating history of the paper unpassing portion (details described later).

Figure 5:
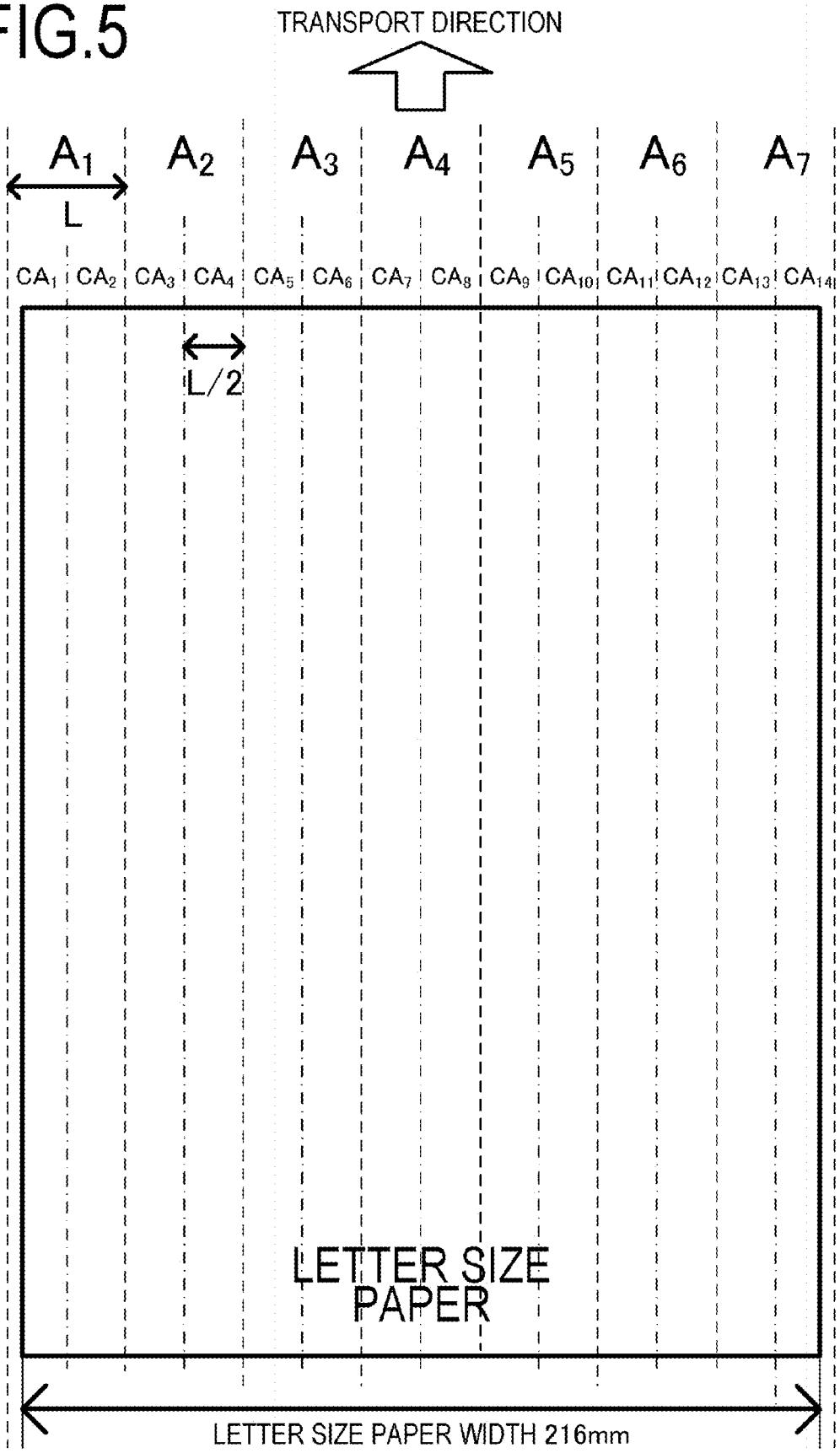
FIG. 5 is a diagram depicting a heating region and a heat accumulation calculating region of the example.

FIG. 5 is a diagram depicting seven heating regions $A_1$ to $A_7$ which are separated in the longer direction of the heater 300 and can be heated by the heater 300, and is depicted in comparison with the size of LETTER size paper. The heating regions $A_1$ to $A_7$ are regions which can be heated by the heating blocks HB1 to HB7 respectively, and the heating region $A_1$ is heated by the heating block HB1 and the heating region $A_7$ is heated by the heating block HB7. Since power to be supplied to the heating resistor in each block is independently controlled, the heating amount of each heating block is independently controlled. The total length of the heating regions $A_1$ to $A_7$ is 220 mm, and each region is determined by equally dividing this length by seven (L=31.4 mm).

In Example 1, thermal history calculating regions $CA_1$ to $CA_{14}$ are disposed, such that each heating region is divided into two in the longer direction of the heater 300. The thermal history calculating region $CA_n$ is a region to calculate the degree of heating, the degree of heat radiation, the heating history and the heat radiating history of the target region (LC=L/2=15.7 mm).

In the case where an image is formed in the recording material transport direction, in only a part of one region $CA_n$ (n=1 to 14) out of fourteen thermal history calculating regions, the region where the image exists is called the image heating portion $PR_n$ (n=1 to 14). In the image heating portion $PR_n$ (n=1 to 14), heating is performed at the above mentioned control target temperature TGT. In Example 1, if there are a plurality of images which are intended to be formed in the thermal history calculating regions $CA_n$ (n=1 to 14) in the recording material transporting direction, a minimum region that includes all the plurality of images in the recording material transport direction is regarded as the image heating portion $PR_n$ (n=1 to 14). In one thermal history calculating region, a portion other than the image heating portion $PR_n$ is regarded as a non-image heating portion PP, which is heated at a temperature lower than the image heating portion $PR_n$. Under the above mentioned conditions, the heater control method in according with the image information and the heater control correction method in accordance with the predicted heat accumulation amount will be described in detail.

6. Heater Control Method in Accordance with Image Information

When the video controller 120 receives image information from the host computer, the video controller 120 determines what kind of image is formed in the thermal history calculating region. Then an intended heating temperature FT, which is an intended value of the control target temperature TGT, is determined so that the image is heated at a higher temperature as the toner amount of the image is higher. In concrete terms, the intended heating temperature FT is determined in accordance with the toner amount equivalent value determined by converting the image density of each color acquired from the CMYK image data into the toner amount, so that the image is heated at a higher temperature as the toner amount equivalent value of the image is higher.

How to Determine Intended Heating Temperature A method of acquiring the toner amount equivalent value D will be described first. The image data from an external device, such as a host computer, is received by the video controller 120 of the image forming apparatus, and is converted into bit map data. A number of pixels of the image forming apparatus of Example 1 is 600 dpi, and the video controller 120 creates bit map data (image density data for each color of CMYK) corresponding to 600 dpi. The image forming apparatus of Example 1 acquires, from the bit map data, an image density value of each color of CMYK for each dot, and converts the image density into the toner amount equivalent value D.

Figure 6:
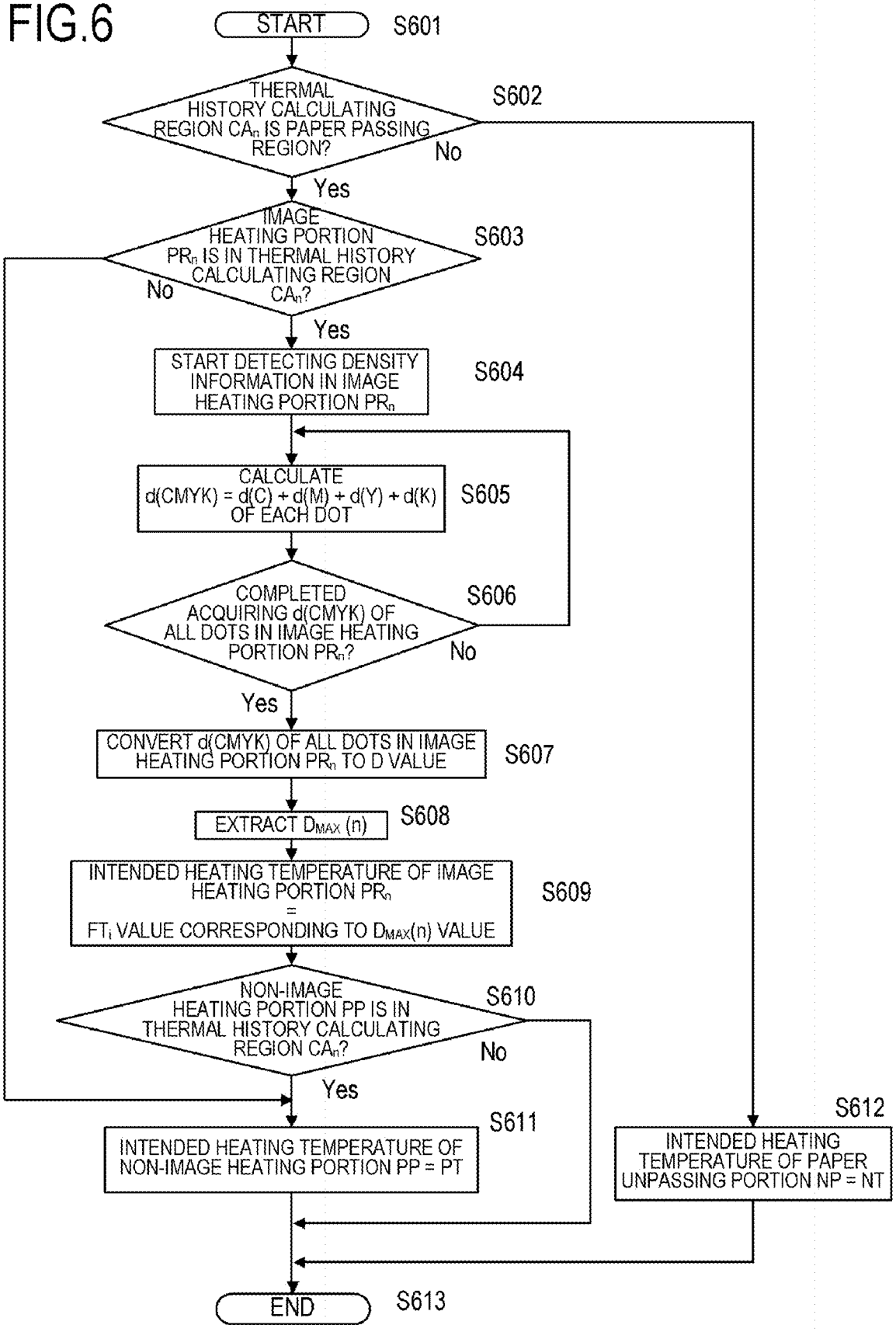
FIG. 6 is a flow chart to determine the intended heating temperature setting according to the example.

FIG. 6 is a flow chart depicting a flow to determine the intended heating temperature of each thermal history calculating region (e.g. $CA_n$) in each page. When the conversion into bit map data completes, as mentioned above, the flow starts in S601. In S602, it is checked whether the thermal history calculating region $CA_n$ is a recording material passing region, and if not, processing advances to S612, and the intended heating temperature NT is set for the paper unpassing portion NP, and processing ends. If the passing region, it is checked whether an image heating portion $PR_n$ exists in the thermal history calculating region $CA_n$ in S603, and if the image heating portion $PR_n$ does not exist, processing advances to S611, the intended heating temperature PT is set for the non-image heating portion PP, and processing ends. If the image heating portion $PR_n$ exists, image density detection of each dot in the image heating portion $PR_n$ is started in S604. From the image data converted into CMYK image data, the image density of each color of C, M, Y and K of each dot, that is, d(C), d(M), d(Y) and d(K) are acquired. In S605, d(CMYK), which is the total of the above image density values, is calculated. This processing is performed for all the dots in the image heating portion $PR_n$, and when acquisition of d(CMYK) for all the dots is confirmed in S606, these values are converted into toner amount equivalent values D in S607.

Here the image information in the video controller 120 is an 8-bit signal, and the image density d(C), d(M), d(Y) and d(K) for each toner color is expressed in a range of minimum density 00h to maximum density FFh. The total thereof, that is, d(CMYK), is a 2 byte 8-bit signal. As mentioned above, this d(CMYK) value is converted into toner amount equivalent value D (%) in S607. In concrete terms, the minimum image density 00h for each toner color is converted into 0%, and the maximum image density FFh thereof is converted into 100%. The toner amount equivalent value D (%) corresponds to the toner amount per unit area on the actual recording material P, and in Example 1, it is assumed that the toner amount on the recording material 0.50 mg/cm$^2$=100%.

Then in S608, the maximum toner amount equivalent value $D_{MAX}(n)$ (%) is extracted from the toner amount equivalent values D (%) of all the dots in the image heating portion $PR_n$. d(CMYK) is a total value of the image densities of a plurality of toner colors, and the maximum toner amount equivalent value $D_{MAX}(n)$ may exceed 100%. In the image forming apparatus of Example 1, the toner amount on the recording material P is adjusted so that the upper limit becomes 1.15 mg/cm$^2$ in a completely solid image (toner amount equivalent value D is 230%). If the maximum toner amount equivalent value $D_{MAX}(n)$ is acquired in S608, an $FT_n$ value (described in detail later), which is a heating temperature corresponding to this maximum toner amount equivalent value $D_{MAX}(n)$, is set as the intended heating temperature for the image heating portion $PR_n$ in S609. Then in S610, it is checked whether the non-image heating portion PP exists in the thermal history calculating region $CA_n$, and if the non-image heating portion PP does not exist, processing flow ends. If the non-image heating portion PP exists, processing advances to S611, and the intended heating temperature PT for the non-image heating portion PP is set, and processing ends.

This flow is performed for the thermal history calculating regions $CA_1$ to $CA_{14}$. In other words, in each region, the intended heating temperature $FT_n$, corresponding to the maximum toner amount equivalent value $D_{MAX}(n)$, is set for the image heating portion $PR_n$, the intended heating temperature PT is set for the non-image heating portion PP, and the intended heating temperature NT is set for the paper unpassing portion NP.

FIG. 7A indicates the relationship between the maximum toner amount equivalent value $D_{MAX}(n)$ and the intended heating temperature $FT_n$ according to Example 1. In Example 1, the intended heating temperature $FT_n$ can be changed in five levels in accordance with the maximum toner amount equivalent value $D_{MAX}(n)$. In the case of an image of which maximum toner amount equivalent value $D_{MAX}(n)$ is high and the toner amount is large, a high temperature is set for the intended heating temperature $FT_n$ so that the toner can be sufficiently fused. For a non-image heating portion PP in which an image is not formed, an intended heating temperature PT, that is lower than that of the image heating portion $PR_n$, is set (e.g. 120° C.). The intended heating temperature PT is a fixed value. For a paper unpassing portion NP where a recording material does not pass, an intended heating temperature NT, that is lower than that of the image heating portion $PR_n$, is set (e.g. 110° C.). The intended heating temperature NT is a fixed value.

7. Heater Control Correction Method in Accordance with Predicted Heat Accumulation Amount In the configuration of Example 1, the intended heating temperature determined like this is corrected in accordance with the predicted heat accumulation amount of each thermal history calculating region, and a control target temperature TGT (described in detail later), which is one of the heating conditions (control setting) to actually heat the recording material P.

How to Determine Predicted Heat Accumulation Amount

In Example 1, the thermal history calculating regions $CA_n$, as illustrated in FIG. 5, are set for the heating regions $A_1$ to $A_7$, and a heat accumulation counter to indicate the thermal history is disposed. As illustrated in FIG. 5, each thermal history calculating region $CA_n$ is determined by dividing each heating region Ai by 2 (LC=15.7 mm). When the count value of the heat accumulation counter is $CT_n$, the heat accumulation count value $CT_n$ indicates the degree of heating, the degree of heat radiation, the heating history and the heat radiating history of each thermal history calculating region $CA_n$ (described in detail later). Using this heat accumulation count value $CT_n$, a region heat accumulation amount $HRV_n$ is determined as the predicted heat accumulation amount of the thermal history calculating regions $CAT_1$ to $CAT_{14}$.

To determine the region heat accumulation amount $HRV_n$ of one thermal history calculating region $CA_n$, the values of the heat accumulation counters of the thermal history calculating region $CA_n$ and the adjacent thermal history calculating regions $CA_{n-1}$ and $CA_{n+1}$, that is, the heat accumulation count values $CT_n$, $CT_{n-1}$ and $CT_{n+1}$, are used (described in detail later).

In Example 1, the region heat accumulation amount HRV is determined as the predicted heat accumulation amount for each page (immediately after the page is printed). Then on the next page, a control target temperature TGT ($PR_n$), which is a temperature at which the image heating portion $PR_n$ of the recording material P is actually heated, is determined in accordance with the determined value of the region heat accumulation amount HRV. The heat accumulation count value CT and the region heat accumulation amount HRV will be described in detail next.

7-1. How to Count Heat Accumulation Count Value

A method of determining a heat accumulation count value CT, which indicates the heating history and the heat radiating history of each thermal history calculating region, will be described. The heat accumulation counter for each thermal history calculating region counts for the thermal history using a predetermined method, in accordance with the heating operation performed for the thermal history calculating region and the passing state of the recording material.

In other words, the history of the heating operation, the passing state of the recording material and the like in each region corresponding to each heating region (each thermal history calculating region) of the constituent member of the fixing portion are acquired as the thermal history. In concrete terms, the history of the heating operation, the passing state of the recording material and the like in each region corresponding to each heating region (each thermal history calculating region) in the fixing nip portion N (the constituent member) where the fixing film 202 and the pressure roller 208 are press-contacted, are acquired as the thermal history.

The count value CT of the heat accumulation counter is expressed by the following (Expression 1).

$$CT=(TC\times HLC)+(WUC+INC+PC)-(RMC\times PLC+DC) \quad \text{(Expression 1)}$$

With reference to FIG. 7A to FIG. 7F, (TC×HLC) and (WUC+INC+PC) which are the thermal history and (RMC×PLC+DC) which is the heat radiating history in (Expression 1) will be described. It is assumed that the heat accumulation count value in Example 1 is updated every page (immediately after the page is printed).

As indicated in FIG. 7B, TC is a value that is determined in accordance with the control target temperature TGT($PR_n$) for heating the image heating portion $PR_n$ of the recording material, and the value TC is greater as the control target temperature TGT($PR_n$) is higher.

As indicated in FIG. 7C, HLC is a value that is determined in accordance with the distance HL (mm) that is taken for heating when the image heating portion $PR_n$ is heated, and the value HLC is greater as HL is longer.

In the heating region in which an image is formed, (TC×HLC) in the image heating portion $PR_i$ and (TC×HLC) in the other portion, that is, the non-image heating portion PP, are added as (TC×HLC), to determine a thermal history per page.

As indicated in FIG. 7D, WUC, INC and PC are fixed values which are counted for the print startup, print interval and post-rotation when printing ends. If the startup time, print interval and post-rotation time change depending on the operation conditions, for example, the values of WUC, INC and PC may be changed accordingly. The parameters that indicate the heating history are not limited to these parameters, but may be other parameters that indicate the temperature history of the heater (constituent member of the fixing portion), and the history of power supplied to the heating elements.

As indicated in FIG. 7D, RMC and DC are fixed values that are counted for the heat transferred from the image heating apparatus by passing of the recording material P and the heat radiated to the open air.

As indicated in FIG. 7E, PLC is a value that is determined with respect to the distance PL (mm) where the recording material P is passed, and a value PLC is greater as PL is longer.

Depending on the type of the recording material and environment conditions, the values of RMC and DC may be changed accordingly. The heat radiation count DC is counted during a time other than when printing, and is counted as a predetermined value after a predetermined time elapses (e.g. incremented by 3 in one minute). The parameters indicating the heat radiating history are not limited to the above parameters, but may be other parameters which indicate the history of passing of recording materials in the heating region and the period when power is not supplied to the heating elements.

As described above, the count value CT of the heat accumulation counter according to Example 1 is counted for each page in each region (immediately after the page is printed) based only on the thermal history information of the region.

7-2. How to Determine Region Heat Accumulation Amount

In Example 1, the region heat accumulation amount HRV is determined as the predicted heat accumulation amount for each page (immediately after the page is printed) based on the above mentioned heat accumulation count value CT. Then in the next page, the control target temperature (TGT ($PR_n$), which is the temperature at which the image heating portion $PR_n$ of the recording material P is actually heated, is determined according to this value. If the count value of the heat accumulation counter for the thermal history calculating region $CA_n$ is denoted as $CT_n$, then the region heat accumulation amount $HRV_n$ for the thermal history calculating region $CA_n$ is calculated using (Expression 2), where $CT_{n-1}$, $CT_n$ and $CT_{n+1}$ are the heat accumulation values.

$$HRV_n=\{CT_n+\alpha(CT_{n-1}+CT_{n+1})\}/(1+2\alpha) \quad \text{(Expression 2)}$$

Here $\alpha$ is a constant.

As indicated in (Expression 2), the region heat accumulation amount $HRV_n$ for a certain thermal history calculating region $CA_n$ is determined from this thermal history calculating region $CA_n$, and adjacent thermal history calculating regions on both sides $CA_{n-1}$ and $CA_{n+1}$. This value is a value that indicates the predicted heat accumulation amount of the thermal history calculating region $CA_n$. The region heat accumulation amounts $HRV_n$ of the adjacent thermal history calculating regions on both sides $CA_1$ and $CA_{14}$ are determined based on the thermal history of this thermal history calculating region and the thermal history of one of the adjacent thermal history calculating regions.

The constant $\alpha$ in (Expression 2) is a value that indicates a degree of influence of the thermal history of the adjacent thermal history calculating regions on the predicted heat accumulation amount of this thermal history calculating region, and $\alpha$=0.2 in the configuration of Example 1. In this way, in the image forming apparatus according to Example 1, the predicted heat accumulation amount of each thermal history calculating region is determined considering the thermal history of the thermal history calculating regions adjacent to this region, whereby the prediction accuracy of the predicted heat accumulation amount is improved. In Example 1, the intended heating temperature $FT_n$ for the image heating portion PR is corrected using the region heat accumulation amount $HRV_n$ determined like this, hence a more appropriate control target temperature TGT ($PR_n$) can be acquired.

FIG. 7F indicates the relationship between the region heat accumulation amount $HRV_n$ and the correction value VA of the intended heating temperature $FT_n$. The relationship between the region heat accumulation amount $HRV_i$ and the correction value VA of the intended heating temperature $FT_i$ is determined in advance, based on the result of checking the heat accumulation state and the image characteristic after fixing by the fixing apparatus of Example 1.

In Example 1, the control target temperature values of the non-image heating portion PP and the paper unpassing portion NP are not corrected using the region heat accumulation amount $HRV_i$ (the control target temperature TGT (PP)=120° C. and TGT(NP)=110° C., regardless the value of the region heat accumulation amount $HRV_i$).

7-3. How to Determine Control Target Temperature

Figure 8:
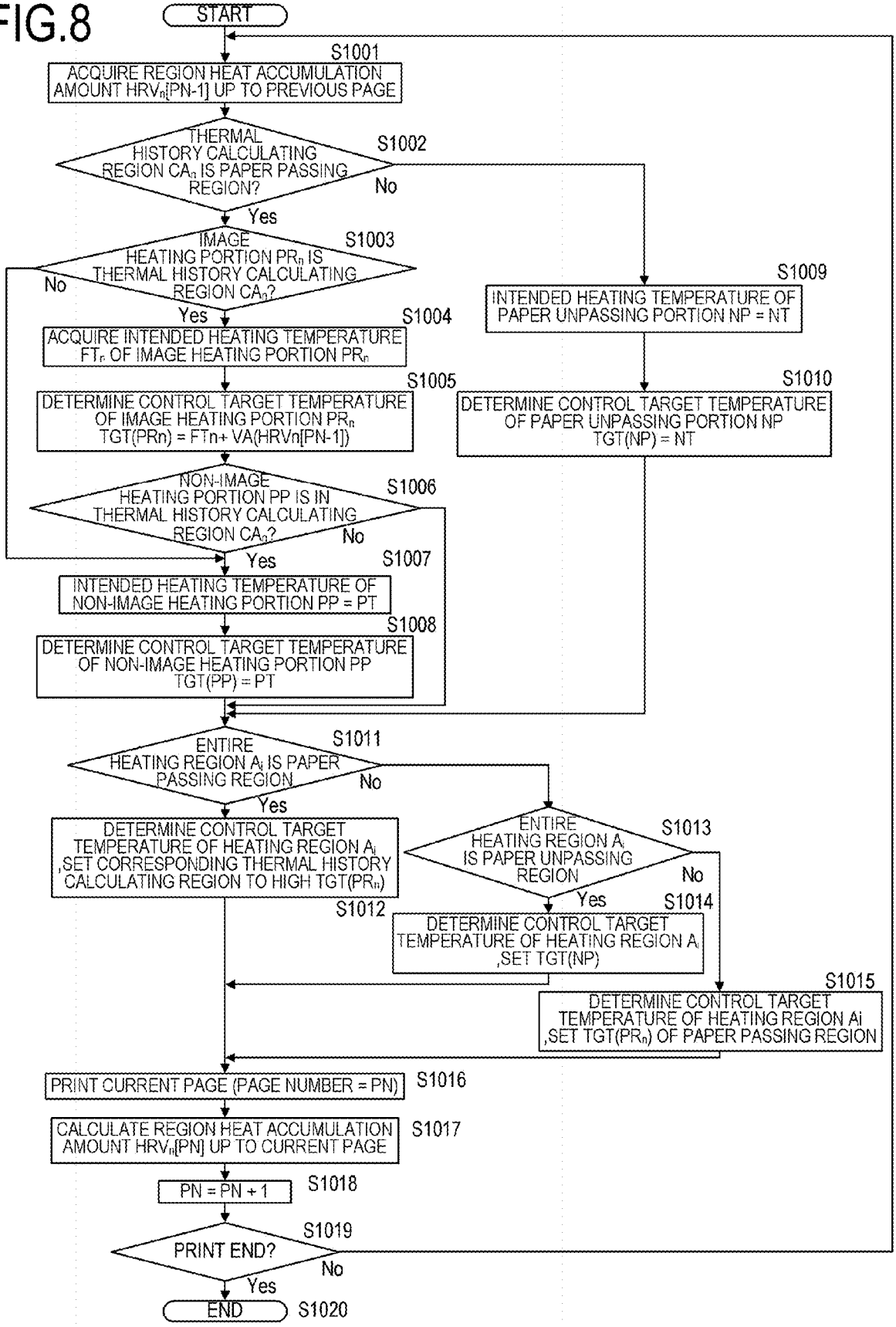
FIG. 8 is a flow chart to determine the control target temperature according to the example.

FIG. 8 is a flow chart to determine the control target temperature TGT for the image heating portion $PR_n$ of the thermal history calculating region $CA_n$, the non-image heating portion PP, and the paper unpassing portion NP according to Example 1. Here PN indicates the current page number. First when the flow starts, the region heat accumulation amount $HRV_n$[PN−1] up to the previous page is acquired in S1001. In S1002, it is checked whether the thermal history calculating region $CA_n$ is a paper passing region of the recording material, and if not, processing advances to S1009 and S1010, where the intended heating temperature NT for the paper unpassing portion NP is set to the control target temperature TGT(NP)(TGT(NP)=NT), and processing ends. If the thermal history calculating region $CA_n$ is a paper passing region, it is checked whether an image heating portion $PR_n$ exists in the thermal history calculating region $CA_n$ in S1003. If the image heating portion $PR_n$ exists, the intended heating temperature $FT_n$, which is determined by the above mentioned control flow in FIG. 6, is acquired for the image heating portion $PR_n$ in S1004. If the image heating portion $PR_n$ does not exist, processing advances to S1007 to determine the control target temperature for the non-image heating portion PP.

In S1005, the intended heating temperature $FT_n$ for the image heating portion $PR_n$ acquired in S1004 is corrected in accordance with the predicted heat accumulation amount. First according to the above mentioned FIG. 7A to FIG. 7F, the correction value VA ($HRV_n$[PN−1]), for the intended heating temperature $FT_n$ is selected in accordance with the region heat accumulation amount $HRV_n$[PN−1] up to the previous page acquired in S1001. Then the intended heating temperature $FT_n$ is corrected by this correction value VA ($HRV_n$[PN−1]) using the following (Expression 3), and the control target temperature TGT($PR_n$) for the image heating portion $PR_n$ is determined.

$$TGT(PR_n)=FT_n+VA(HRV_n[PN-1]) \quad \text{(Expression 3)}$$

When the control target temperature TGT($PR_n$) for the image heating portion $PR_n$ is determined like this in S1005, it is checked whether a non-image heating portion PP exists in the thermal history calculating region $CA_n$ in S1006. If the non-image heating portion PP exists, the intended heating temperature PT for the non-image portion PP and the control target temperature TGT(PP) are determined (TGT(PP)=PT) in S1007 and S1008, and processing advances to S1011. If the non-image heating portion PP does not exist, processing advances directly from S1006 to S1011.

In S1011, it is checked whether the entire region of the heating region $A_i$ is the paper passing region of the recording material, and if the entire region is the paper passing region, processing advances to S1012, and the control target temperature $TGT(A_i)$ of the heating region $A_n$ is determined from the control target temperature TGT(PR) of a plurality of thermal history calculating regions $CA_n$ constituting the heating region $A_i$. In this case, the control target temperature is set to the highest control target temperature TGT out of the control target temperatures $TGT(PR_n)$ of the plurality of thermal history calculating regions $CA_n$ constituting the heating region $A_i$.

If it is determined that the entire region of the heating region $A_i$ is not the paper passing region in S1011, processing advances to S1013. In S1013, it is checked whether the entire region of the heating region $A_i$ is a paper unpassing region of the recording material, and if the entire region is the paper unpassing region, processing advances to S1014, and the control target temperature TGT(NP) is set for the heating region $A_i$.

If it is determined that the entire region of the heating region $A_i$ is not the paper unpassing region of the recording material in S1013, processing advances to S1015 to determine the control target temperature. In the heating region $A_i$ in this state, the paper passing region and the paper unpassing region exist, and the edge of the recording material in the longer direction passes this heating region $A_i$. In this case, the control target temperature is set to the highest control target temperature TGT out of the control target temperatures TGT(PR) in the paper passing regions of a plurality of thermal history calculating regions $CA_n$ constituting the heating region $A_i$. In this case, the paper passing region is thermally influenced by the paper unpassing region, but the region heat accumulation amount HRV of the paper unpassing region is calculated, and the influence of the paper unpassing region is reflected in the region heat accumulation amount HRV of the paper passing region using (Expression 2). Therefore the accuracy of the control target temperature of the paper passing region can be improved.

In S1016, the current page (page number=PN) is printed using the control target temperature TGT which was determined in the flow thus far. Then in S1017, the region heat accumulation amount $HRV_n$[PN] up to the current page is calculated, and in S1018, the page number is updated to that of the next page. In S1019, it is checked whether printing ends, and the flow ends here if printing ends with the current page, or the flow after S1001 is repeated if printing continues.

An example of the control when a recording material, of which paper passing region is narrower than the maximum heating region width and of which width does not match with the width of the heating region, is printed, will be described next.

Figure 9:
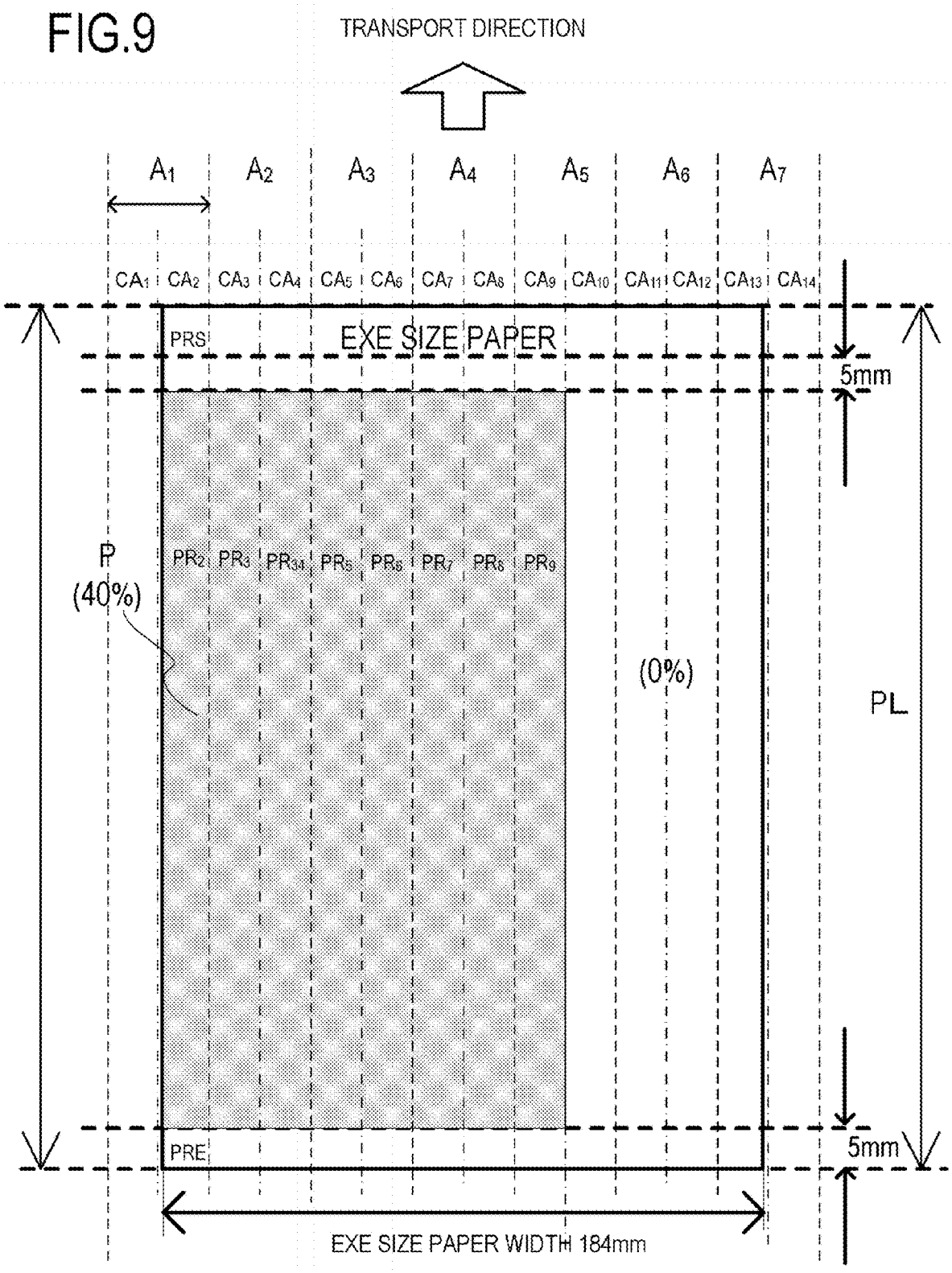
FIG. 9 is a diagram depicting an image pattern example according to Example 1.

FIG. 9 is a diagram depicting the paper passing position, the heating region and the thermal history calculating region when EXECUTIVE size paper (width: 184 mm, length: 267 mm) is printed. The regions from $A_2$ to $A_6$ are controlled as the paper passing region, just like the above mentioned case of LETTER size paper. In $A_1$ and $A_7$, a paper passing region and a paper unpassing region exist, since the heating region dividing width and the recording material width do not match. In the heating region $A_1$, the thermal history calculating region $CA_1$ is a paper unpassing region, the thermal history calculating region $CA_2$ is a paper passing region, and in the heating region $A_7$, the thermal history calculating region $CA_{14}$ is a paper unpassing region, and the thermal history calculating region $CA_{13}$ is a paper passing region.

8. Comparison with Comparative Example

The configuration of Example 1 of the present invention will be described in comparison with the configuration of the comparative example. A case of printing the image pattern in FIG. 9 will be described as an example.

8-1. Description on Image Pattern

The image pattern in FIG. 9 will be described. In FIG. 9, an image formed on EXECUTIVE size paper (width: 184 mm, length: 267 mm) is illustrated. The image P is formed in the thermal history calculating region $CA_2$ on the edge portion of EXECUTIVE size paper to the thermal history calculating region $CA_9$. In the image P, tertiary colors (cyan (C), magenta (M) and yellow (Y)) of which toner amount equivalent value D (%) is 40% are uniformly formed (maximum toner amount equivalent value $D_{MAX}(i)(\%)=40\%$). The start portion of the image heating portion PR is indicated by PRS, and the end portion is indicated by PRE.

The start portion PRS of the image heating portion PR in Example 1 is set at the upstream side in the transport direction of the recording material from the front end of the image by 5 mm. The end portion PRE of the image heating portion $PR_n$ in Example 1 is set at the downstream side in the transport direction of the recording material from the rear end of the image by 5 mm.

As mentioned above, the temperature at which the recording material is actually heated is the control temperature TGT. In Example 1, before the start portion PRS of the image heating portion PR is reached, the heater temperature has risen from the control temperature TGT(PP) for the non-image heating portion PP (e.g. intended heating temperature PT=120° C.), to the control temperature TGT(PR) used for heating the image heating portion $PR_n$. In other words, before reaching the start portion PRS of the image heating portion $PR_n$, temperature has risen so that the surface temperature of the fixing film 202 reaches a temperature which is required to fix the image.

In Example 1, the above mentioned distance HL (mm) where heating is performed, indicated in FIG. 7C, is the total of the length of the image heating portion $PR_n$ in recording material transport direction and the distance required for the above mentioned temperature rising. In accordance with this distance HL (mm) where heating is performed, the value of LC in the above (Expression 1) is determined, and is used for calculating the heat accumulation count value CT. In the case of the image pattern in FIG. 9, the distance HL (mm) where the image heating portion PR is heated is 267 mm, which is the same as the length of EXECUTIVE size paper in the transport direction, and the above mentioned temperature rising operation is started from the front end of the recording material. The heating distance HL (mm) of an image, which will be used in the following description, is also a total distance of the length of the image heating portion PR in the recording material transport direction and the distance required for the temperature rising operation.

8-2. Description of Comparative Conditions

Using the image pattern in FIG. 9 described above, 70 pages of EXECUTIVE size paper are continuously printed.

The temperature that is set as the control temperature TGT for each heating region will be compared between Example 1 of the present invention which is described below and the comparative example.

8-3. Description of Example 1

In the configuration of Example 1, the intended heating temperature $FT_n$ for the image heating portion $PR_n$ is corrected in accordance with FIG. 8, using the region heat accumulation amount $HRV_n$ acquired from the above mentioned (Expression 1) and (Expression 2), whereby the control temperature TGT(A) is determined. As mentioned above, FIG. 7F indicates the relationship between the region heat accumulation amount $HRV_n$ and the correction value VA of the intended heating temperature $FT_i$.

First EXECUTIVE size paper having the image pattern in FIG. 9 is continuously printed, and the region heat accumulation amount $HRV_n$ of Example 1 in each thermal history calculating region $CA_1$ to $CA_{14}$ is checked. The paper passing width of EXECUTIVE size paper is 184 mm, that is, the paper passing region is narrower than the maximum heating region width of Example 1 (total length of heating regions $A_1$ to $A_7$ is 220 mm), and is wider than the heating region width of the heating elements $A_2$ to $A_6$ (157 mm), which is disposed inside the paper passing region. Since the heating region divided positions and the width of the recording material do not match, a paper passing region and a paper unpassing region exist in the heating regions $A_1$ and $A_7$. In the heating region $A_1$, the thermal history calculating region $CA_1$ is a paper unpassing region, and the thermal history calculating region $CA_2$ is a paper passing region, and in the heating region $A_7$, the thermal history calculating region $CA_{14}$ is a paper unpassing region, and the thermal history calculating region $CA_{13}$ is a paper passing region.

FIG. 10A indicates the maximum toner amount equivalent value $D_{MAX}$, the intended heating temperature FT, the intended heating temperature PT, the intended heating temperature NT, the region heat accumulation amount $HRV_n$, and the region control target temperature in each thermal history calculating region $CA_1$ to $CA_{14}$ according to the configuration of Example 1 when 70 pages are printed. Furthermore, control target temperatures ($A_i$) in each of the heating regions $A_1$ to $A_7$, which are calculated in accordance with the above flows are indicated in FIG. 10A.

Figure 11A:
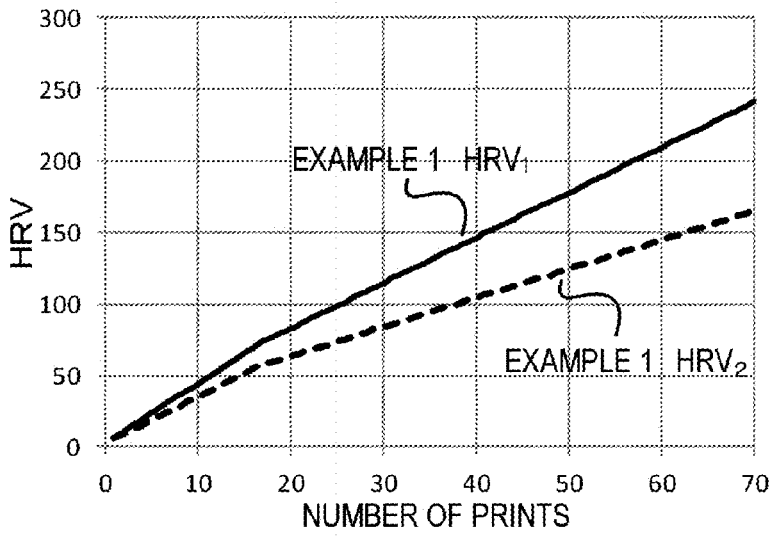
FIG. 11A and FIG. 11B respectively indicate a graph indicating the transition of the region heat accumulation amount and a graph indicating film surface temperature distribution according to Example 1.

FIG. 11A indicates a transition of the region heat accumulation amount HRV of the thermal history calculating regions $CA_1$ and $CA_2$ according to Example 1, when the image pattern in FIG. 9 is continuously printed. The thermal history calculating region $CA_1$ is a paper unpassing region where heat is not transferred from the image heating apparatus by passing of the recording material P, hence the heat accumulation amount increases compared with the thermal history calculating region $CA_2$ which is a paper passing region. As a result, the value of the region heat accumulation amount immediately after printing 70 pages is 241 in the case of $HRV_1$, and is 165 in the case of $HRV_2$.

As described above, according to Example 1, the thermal history calculating regions are set by dividing the heating regions, then the region heat accumulation amount HRV of the paper unpassing region is calculated, and the influence of this value is reflected in the region heat accumulation amount HRV of the paper passing region. Therefore, as indicated in FIG. 10A, the control target temperature of the heating region $A_1$ where the edge of the recording material passes is set to $TGT(A_1)=178°$ C., which is lower than those of the heating regions $A_2$ to $A_5$ at the center portion of the recording material.

8-4. Description of Comparative Example

In Example 1, a plurality of thermal history calculating regions $CA_n$ are set for each heating region $A_i$ to $A_7$, and the thermal history is calculated thereby, but in the configuration of the comparative example, a heat accumulation counter is disposed for each heating region. In the comparative example, the predicted heat accumulation amount is calculated for each heating region, and the intended heating temperature $FT_i$ for the image heating portion $PR_i$ is corrected based on this predicted heat accumulation amount, whereby the control temperature $TGT(PR_i)$ is determined.

Figure 12:
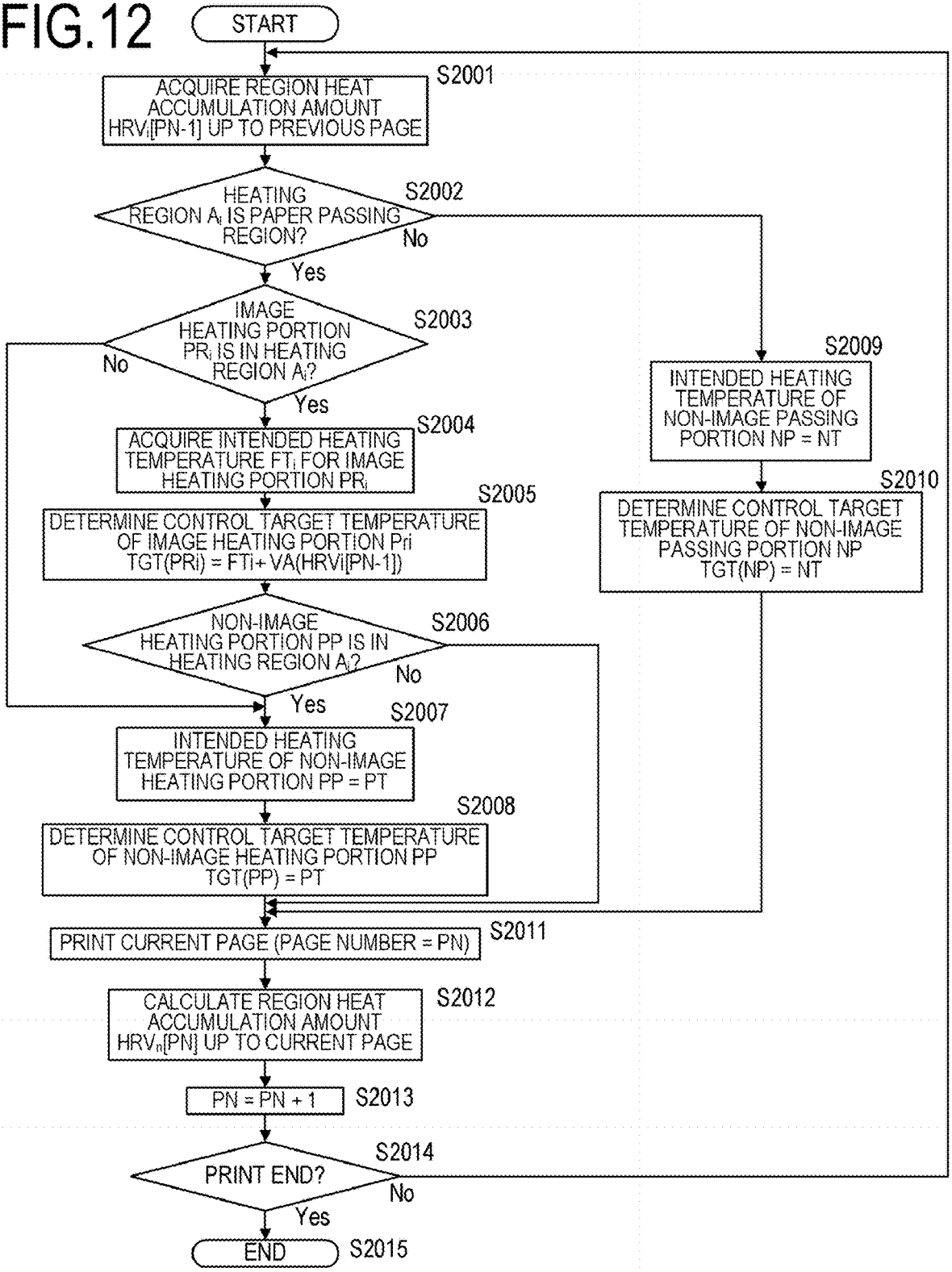
FIG. 12 is a flow chart to determine the control target temperature according to a comparative example.

FIG. 12 is a flow chart to determine the control target temperature TGT for the image heating portion $PR_i$, the non-image heating portion PP, and the paper unpassing portion NP according to the comparative example. First when the flow starts, the region heat accumulation amount $HRV_i[PN-1]$ up to the previous page is acquired in S2001. In S2002, it is checked whether the heating region $A_i$ is a paper passing region of the recording material, and if not, processing advances to S2009 and S2010, where the intended heating temperature NT for the paper unpassing portion NP is set to the control target temperature TGT(NP) (TGT(NP)=NT), and processing ends. If the heating region $A_i$ is a paper passing region, it is checked whether an image heating portion PR exists in the heating region $A_i$ in S2003. If the image heating portion $PR_i$ exists, the intended heating temperature FT is acquired for the image heating portion $PR_i$ in S2004. If the image heating portion $PR_i$ does not exist, processing advances to S2007 to determine the control target temperature for the non-image heating portion PP.

In S2005, the intended heating temperature FT for the image heating portion $PR_i$ acquired in S2004 is corrected in accordance with the predicted heat accumulation amount. First the correction value VA ($HRV_i[PN-1]$) for the intended heating temperature $FT_i$ is selected in accordance with the region heat accumulation amount HRV[PN−1] up to the previous page acquired in S2001. Then the intended heating temperature $FT_i$ is corrected by this correction value VA ($HRV_i[PN-1]$) using (Expression 3), and the correction target temperature $TGT(PR_i)$ for the image heating portion $PR_i$ is determined.

When the control target temperature TGT(PR) for the image heating portion $PR_n$ is determined like this in S2005, it is checked whether a non-image heating portion PP exists in the heating region $A_i$ in S2006. If the non-image heating portion PP exists, the intended heating temperature PT and the control target temperature TGT(PP) for the non-image heating portion PP are determined (TGT(PP)=PT) in S2007 and S2008, and processing advances to S2011. If the non-image heating portion PP does not exist, processing advances directly from S2006 to S2011.

In S2011, the current page (page number=PN) is printed using the control target temperature TGT which was determined in the flow thus far. Then in S2012, the region heat accumulation amount $HRV_i[PN]$ up to the current page is calculated, and in S2013, the page number is updated to that of the next page. In S2014, it is checked whether printing ends, and the flow ends here if printing ends with the current page, or the flow after S2001 is repeated if printing continues.

8-5. Comparison of Example 1 and Comparative Example

The control temperature TGT, in the case of printing 70 pages of EXECUTIVE size paper having the image pattern in FIG. 9, will be described with reference to FIG. 10A and FIG. 10B. As mentioned above, according Example 1, the thermal history calculating regions are set by dividing the heating regions, then the region heat accumulation amount HRV of the paper unpassing region is calculated, and the influence of this value is reflected in the region heat accumulation amount HRV of the paper passing region. Therefore as indicated in FIG. 10A, the control target temperature of the heating region $A_i$, where the edge of the recording material passes, is set to $TGT(A_1)=178°$ C., which is lower than those of the heating regions $A_2$ to $A_5$ at the center portion of the recording material. In the comparative example, on the other hand, the heat accumulation state is calculated regarding the heating region $A_1$, where the edge of the recording material passes, as one paper passing region, hence the temperature state of the paper unpassing portion cannot be reflected in the result. Therefore, as indicated in FIG. 10B, $TGT(A_1)=183°$ C. is set for the heating region $A_i$, which is the same control target temperature as those of the heating regions $A_2$ to $A_5$ at the center portion of the recording material.

Figure 11B:
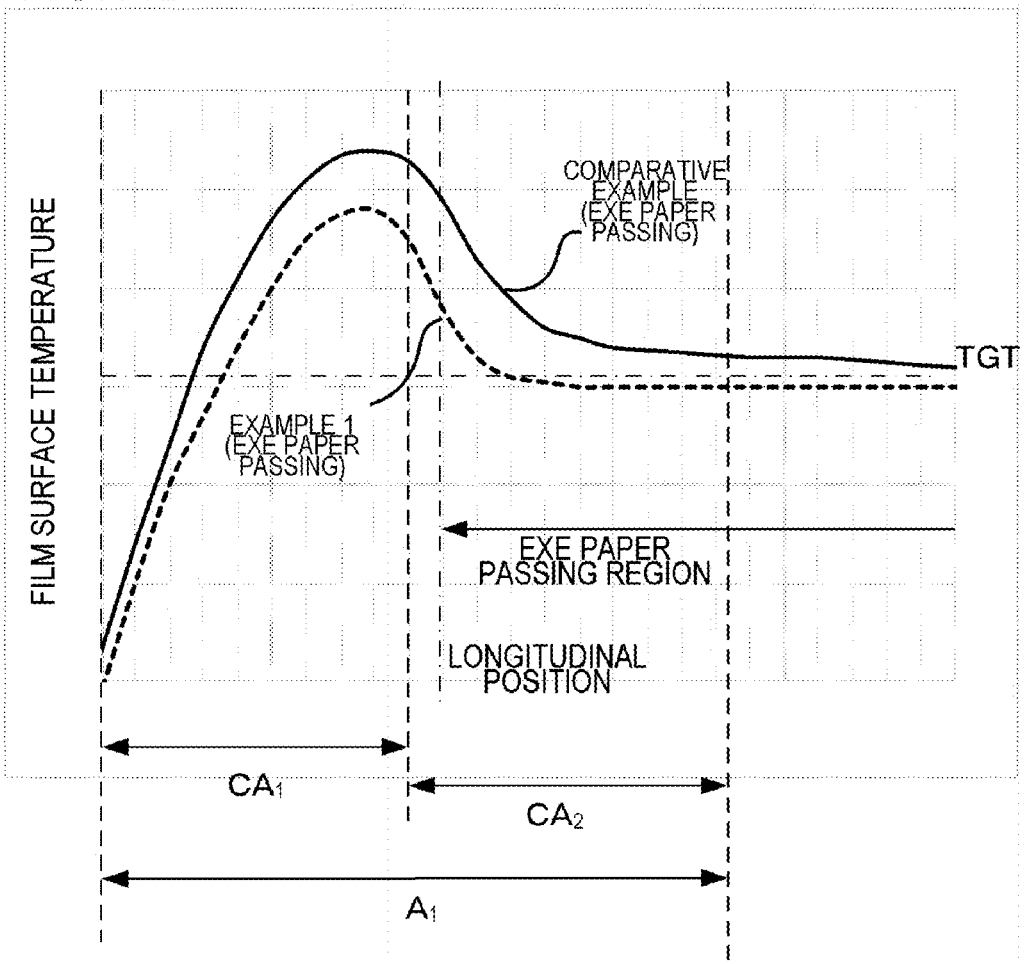

FIG. 11B indicates a fixing film surface temperature distribution in the vicinity of the heating region $A_1$ when EXECUTIVE size paper is continuously printed according to Example 1 and the comparative example. As indicated in FIG. 11B, the temperature rises in the paper unpassing region of EXECUTIVE size paper since heat is not transferred to the recording material (hereafter called "paper unpassing portion temperature rising"). In the case of the comparative example, because of the increase in the paper unpassing portion temperature rising, heat is transferred from the paper unpassing region to the paper passing region, and the film surface temperature of the edge region of EXECUTIVE size paper considerably rises from the control target temperature TGT (film). In the case of the configuration of Example 1, on the other hand, the heat accumulation amount in the region where the paper unpassing portion temperature rising is occurring is calculated, and the result is reflected in the control temperature setting of the paper passing portion, hence the paper unpassing portion temperature rising is reduced, and the film temperature rising in the edge region of EXECUTIVE size paper can be suppressed.

In the case of the comparative example, excessive heat is supplied to the image heating region at the edge of the recording material, more than the heated amount that is actually required. As a result, the control temperature TGT is set to be higher than Example 1. This results in the generation of a hot offset, that is, image P toner adheres to the surface of the fixing film 202 by overheating, and this adhered toner attaches to the recording material after one rotation. Unnecessary power is consumed for this amount of the high temperature setting, which diminishes the power saving performance.

In the case of Example 1, a region heated by one heating element is divided into a plurality of heating regions, then thermal history of a region of the constituting member of the fixing portion corresponding to each heating region is calculated, and the heat accumulation amount is predicted considering the influence of the thermal history of the regions of the constituting members of the fixing portions corresponding to the adjacent heating regions. Thereby a value close to the actual heat accumulation amount can be predicted more accurately than the comparative example. As a consequence, the generation of such image defects as a hot offset can be suppressed, and a better power saving performance can be implemented.

As described above, in the image forming apparatus that adjusts the heating conditions of a plurality of heating blocks, which are disposed in the longer direction of the heater 300, in accordance with the image information, the heat accumulation amount of each region in the constituting member of the fixing portion corresponding to each heating region can be predicted more accurately in Example 1 than in the comparative example. Hence according to Example 1, better output images can be acquired while improving the power saving performance with respect to the comparative example. Furthermore, by decreasing the paper unpassing portion temperature rising, the abrasion of the fixing film and the pressure roller by the edge of the recording material can be suppressed, and the life of the fixing apparatus can be extended.

In Example 1, a case of using EXECUTIVE size paper was described as an example, but the effect can be implemented for other recording material sizes as well.

Example 2

Example 2 of the present invention will be described next. In the configuration of Example 2 of the present invention, the control target temperature TGT(PR) of the paper passing portion is corrected based on the heat accumulation amount of the thermal history calculating region corresponding to the paper unpassing region. The configuration of the image forming apparatus, the image heating apparatus, the heater and the heater control amount according to Example 2 are the same as Example 1, hence description thereof is omitted. The issues that are not especially described in Example 2 are the same as Example 1.

A method of determining the control target temperature at the edge of the recording material will be described below.

According to this configuration, in S1015 of the above mentioned control flow in FIG. 8, the control target temperature $TGT(PR_n)$ for the image heating portion $PR_n$ is corrected in accordance with the heat accumulation count value in the thermal history calculating region, which is an adjacent paper unpassing portion. In the heating region $A_1$ in this state, the paper passing region and the paper unpassing region exist, and the edge of the recording material in the longer direction passes the heating region $A_i$.

First according to FIG. 13, the correction value VN ($HRV_n[NP]$) for the intended heating temperature $FT_n$ is selected in accordance with the region heat accumulation amount $HRV_n[PN-1]$ of a thermal history calculating region, which is an adjacent paper unpassing region. Then the control target temperature $TGT(PR_n)$ is corrected by this correction value VN ($HRV_n[PN-1]$) using the following (Expression 4), and the control target temperature $TGT(A_i)$ of the heating region $A_n$ is determined.

$$TGT(A_i)=TGT(PR_n)+VN(HRV_n[NP]) \quad \text{(Expression 4)}$$

As indicated in (Expression 4), VN ($HRV_n[NP]$) is a value which represents a degree of influence of the temperature rising of the thermal history calculating region, which is an adjacent paper unpassing region.

In the case of Example 2, a region heated by one heating element is divided into a plurality of heating regions, then thermal history is calculated, and the heat accumulation amount is predicted considering the influence of the thermal history of adjacent heating regions. Thereby a value close to the actual heat accumulation amount can be predicted more accurately than the comparative example. As a consequence, the generation of such image defects as a hot offset can be suppressed, and a better power saving performance can be implemented.

As described above, in the image forming apparatus that adjusts the heating conditions of a plurality of heating blocks disposed in the longer direction of the heater 300 in accordance with the image information, the heat accumulation amount of each heating region can be predicted more accurately in Example 2 than in the comparative example. Hence according to Example 2, better output images can be acquired while improving the power saving performance with respect to the comparative example.

Example 3

Example 3 of the present invention will be described next. In the configuration of Example 3 of the present invention, the heat accumulation count value of the thermal history calculating region is corrected in accordance with the ratio of the paper passing width between the paper passing portion and the paper unpassing portion. In Example 3, the configuration of the image forming apparatus, the image heating apparatus, the heater and the heater control circuit are the same as Example 1, hence description thereof is omitted. The issues that are not especially described in Example 3 are the same as Example 1.

A method of determining the control target temperature of the edge of the recording material will be described below.

9. Heater Control Correction Method in Accordance with Predicted Heat Accumulation Amount In the configuration of Example 3, the intended heating temperature is corrected in accordance with the predicted heat accumulation amount of each thermal history calculating region, and a control target temperature TGT (described in detail later) which is one of the heating conditions to actually heat the recording material P.

How to Determine Predicted Heat Accumulation Amount

Figure 14A:
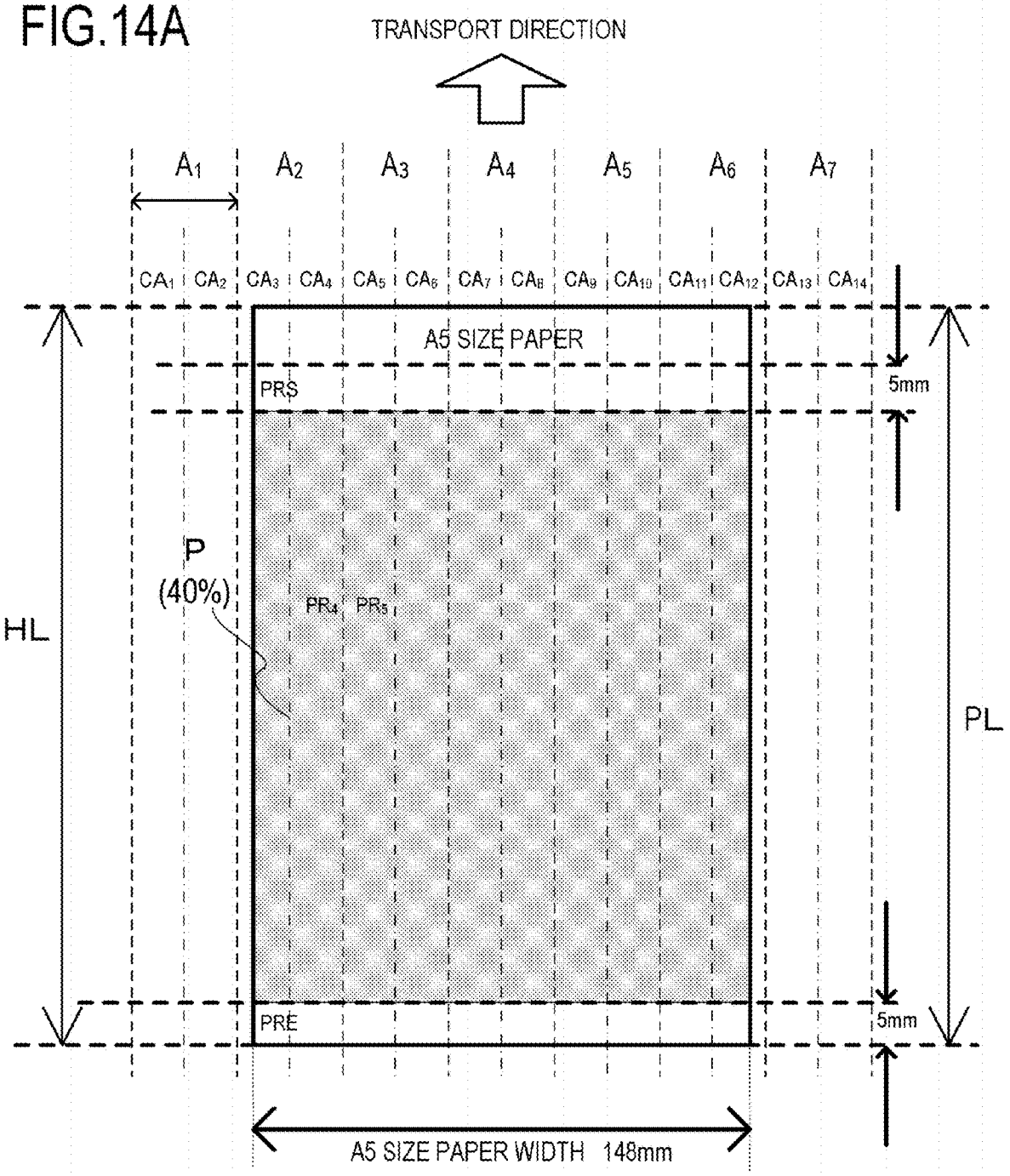
FIG. 14A is a diagram depicting an image pattern example according to Example 3.
Figure 14B:
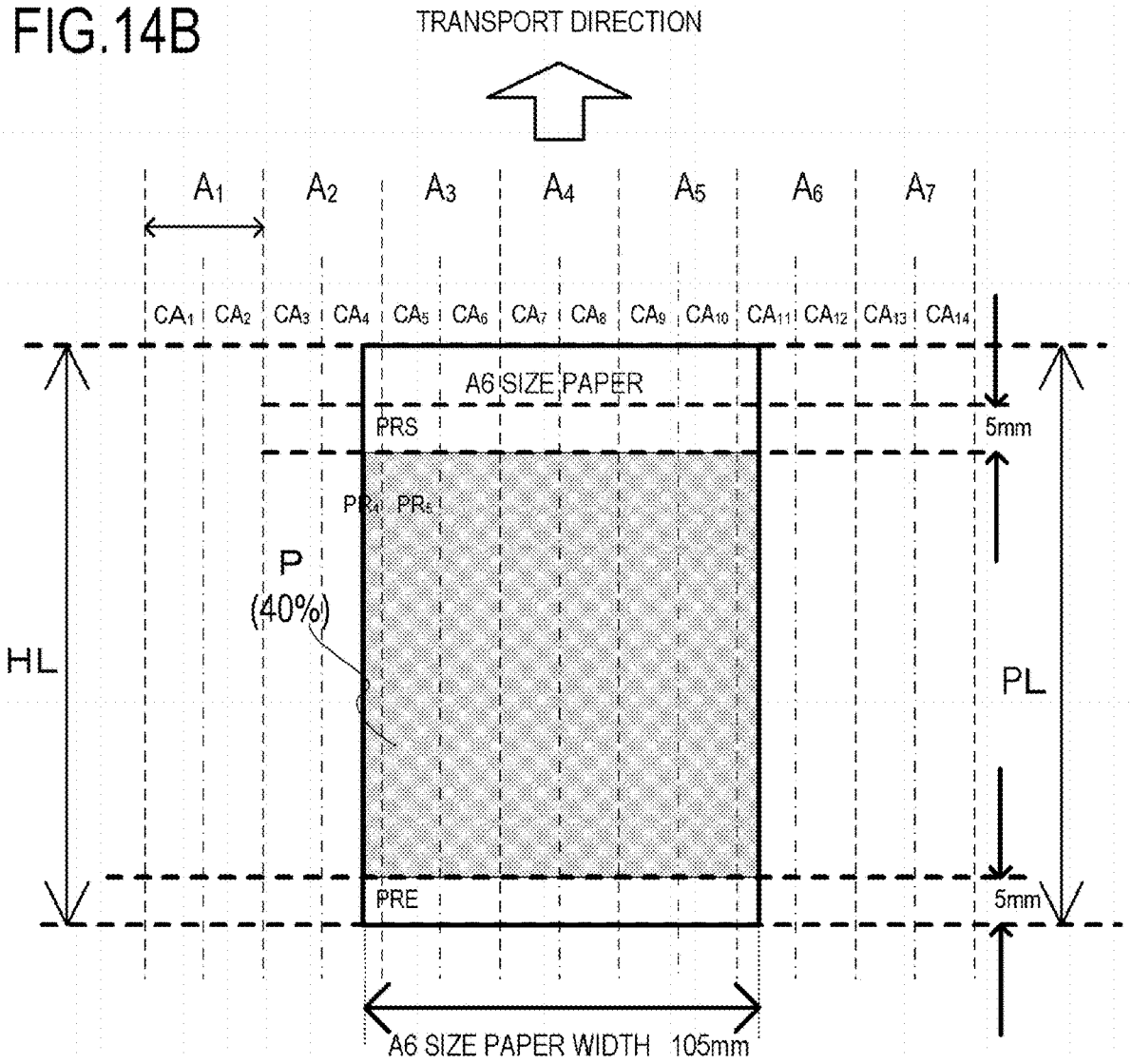
FIG. 14B is a diagram depicting an image pattern example according to Example 3.

In Example 3, the thermal history calculating regions $CA_n$, as illustrated in FIG. 14A and FIG. 14B, are set for the heating regions $A_1$ to $A_7$, and a heat accumulation counter to indicate the thermal history is disposed. As illustrated in FIG. 14A and FIG. 14B, each thermal history calculating region $CA_n$ is determined by dividing each heating region $A_i$ by 2 (LC=15.7 mm). Using this heat accumulation count value $CT_n$, a region heat accumulation amount HRV is determined as the predicted heat accumulation amount of the thermal history calculating regions $CAT_1$ to $CAT_{14}$.

In Example 3, the region heat accumulation amount HRV is determined as the predicted heat accumulation amount for each page (immediately after the page is printed). Then in the next page, a control target temperature TGT(PR), which is a temperature at which the image heating portion $PR_n$ of the recording material P is actually heated, is determined in accordance with the value of the determined region heat accumulation amount HRV. The heat accumulation count value CT and the region heat accumulation amount HRV will be described in detail later.

9-1. How to Determine Heat Accumulation Counter Value

A method of determining a heat accumulation count value CT, which indicates the heating history of the heat radiating history of each thermal history calculating region, will be described. The heat accumulation counter for each thermal history calculating region counts for the thermal history using a predetermined method, in accordance with the heating operation performed for the thermal history calculating region and the passing state of the recording material. The count value CT of the heat accumulation counter is expressed by the following (Expression 1), just like Example 1.

$$CT=(TC\times HLC)+(WUC+INC+PC)-(RMC\times PLC+DC) \quad \text{(Expression 1)}$$

As described above, the count value CT of the heat accumulation counter according to Example 3 is counted for each region, for each page (immediately after the page is printed) based only on the thermal history information on the region.

9-2. How to Count Heat Accumulation Counter Value at Edge of Recording Material In the configuration of Example 3, the heat accumulation count value of the thermal history calculating region where the edge of the recording material passes is corrected by the ratio of the paper passing region and the paper unpassing region.

Figure 17A:
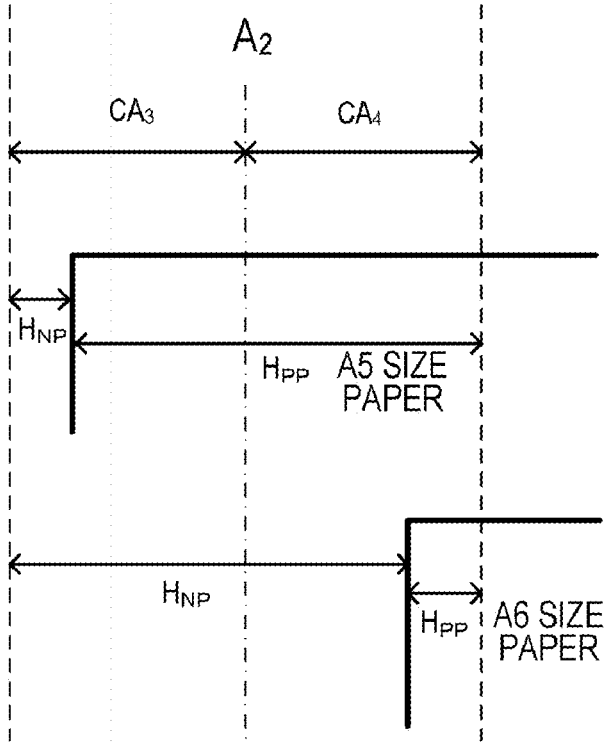
FIG. 17A and FIG. 17B respectively indicate a recording material feeding example and film surface temperature distribution according to Example 3.

FIG. 17A is a diagram depicting each paper passing position at the edge of the recording material when A5 size paper and $A_6$ size paper are printed. When A5 size paper is printed, the thermal history calculating region $CA_3$ has a paper unpassing region and a paper passing region, and when $A_6$ size paper is printed, the thermal history calculating region $CA_4$ has a paper unpassing region and a paper passing region. The width of this paper passing region is assumed to be $H_{PP}$, and the width of this paper unpassing region is assumed to be $H_{NP}$.

In the thermal history calculating region where the edge of the recording material passes, a paper passing heat accumulation count $CT_n(PP)$ in the paper passing state and a paper unpassing heat accumulation count $CT_n(NP)$ in the paper unpassing state are calculated. The count value $CT_n$ of the heat accumulation counter in the entire thermal history calculating regions $CA_n$ is calculated by (Expression 5).

$$CT_n=CT_n(PP)\times\{H_{PP}/(H_{PP}+H_{NP})\}+CT_n(NP)\times\{H_{NP}/(H_{PP}+H_{NP})\} \quad \text{(Expression 5)}$$

Here $\{H_{PP}/(H_{PP}+H_{NP})\}$ is a ratio of the paper passing region, and the heat accumulation amount of the paper passing region is calculated by multiplying the paper passing heat accumulation count $CT_n(PP)$ by this ratio. Further, $\{H_{NP}/(H_{PP}+H_{NP})\}$ is a ratio of the paper unpassing region, and the heat accumulation amount of the paper unpassing region is calculated by multiplying the paper unpassing heat accumulation count $CT_n(NP)$ by this ratio.

As described above, even in the state where the recording material feeding width does not match with the thermal history calculating regions, the heat accumulation amount can be accurately calculated by performing the correction in accordance with the ratio of the paper passing region and the paper unpassing region.

9-3. How to Determine Region Heat Accumulation Amount

In Example 3, the region heat accumulation amount HRV is determined as the predicted heat accumulation amount for each page (immediately after the page is printed) based on the above mentioned heat accumulation count value CT.

Then in the next page, the control target temperature TGT ($PR_n$), which is the temperature at which the image heating portion $PR_n$ of the recording material P is actually heated, is determined according to this value. If the count value of the heat accumulation counter for the thermal history calculating region $CA_n$ is denoted as $CT_n$, then just like Example 1, the region heat accumulation amount $HRV_n$ for the thermal history calculating region $CA_n$ is calculated using (Expression 2), where $CT_{n-1}$, $CT_n$ and $CT_{n+1}$ are the heat accumulation count values.

$$HRV_n=\{CT_n+\alpha(CT_{n-1}+CT_{n+1})\}/(1+2\alpha) \quad \text{(Expression 2)}$$

Here $\alpha$ is a constant.

As indicated in (Expression 2), the region heat accumulation amount $HRV_n$ for a certain thermal history calculating region $CA_n$ is determined from this thermal history calculating region $CA_n$ and adjacent thermal history calculating regions on both sides $CA_{n-1}$ and $CA_{n+1}$. This value is a value that indicates the predicted heat accumulation amount of the thermal history calculating region $CA_n$. The region heat accumulation amounts $HRV_n$ of the adjacent thermal history calculating regions on both sides $CA_1$ and $CA_{14}$ are determined based on the thermal history of this thermal history calculating region and the thermal history of one of the adjacent thermal history calculating regions.

The constant $\alpha$ in (Expression 2) is a value that indicates a degree of influence of the thermal history of adjacent thermal history calculating regions on the predicted heat accumulation amount of this thermal history calculating region, and $\alpha$=0.2 in the configuration of Example 3. In this way, in the image forming apparatus according to Example 3, the predicted heat accumulation amount of each thermal history calculating region is determined considering the thermal history of the thermal history calculating regions adjacent to this region, whereby the prediction accuracy of the predicted heat accumulation amount is improved. In Example 3, the intended heating temperature $FT_n$ for the image heating portion PR is corrected using the region heat accumulation amount $HRV_n$ determined like this, hence a more appropriate control target temperature TGT ($PR_n$) can be acquired.

FIG. 7F indicates the relationship between the region heat accumulation amount $HRV_n$ and the correction value VA of the intended heating temperature $FT_n$. The relationship between the region heat accumulation amount $HRV_i$ and the correction value VA of the intended heating temperature $FT_i$ is determined in advance based on the result of checking the heat accumulation state and image characteristic after fixing by the fixing apparatus of Example 3.

In Example 3, the control target temperature value of the non-image heating portion PP and the paper unpassing portion NP are not corrected using the region heat accumulation amount $HRV_i$ (the control target temperature TGT (PP)=120° C. and TGT (NP)=110° C., regardless the value of the region heat accumulation amount $HRV_i$).

9-4. How to Determine Control Target Temperature

The target temperature setting flow according to Example 3 is the same as Example 1, and in accordance with the flow chart in FIG. 8, the control target temperature TGT for the image heating portion $PR_n$ of the thermal history calculating region $CA_n$, the non-image heating portion PP and the paper unpassing portion NP are determined.

An example of control when a recording material, of which paper passing region is narrower than the maximum heating region width and of which width does not match with the width of the heating region, is printed, will be described next.

FIG. 14A is a diagram depicting the paper passing position, the heating region and the thermal history calculating region when A5 size paper (width: 148 mm, length: 210 mm) is printed, and FIG. 14B is a diagram depicting these when $A_6$ size paper (width: 105 mm, length: 148 mm) is printed. The control for the $A_3$ to $A_5$ regions is controlled as the paper passing region, which is the same as the above mentioned LETTER size paper. In $A_2$ and $A_6$, a paper passing region and a paper unpassing region exist, since the heating region dividing width and the recording material width do not match.

10. Comparison with Comparative Example

The configuration of Example 3 of the present invention will be described in comparison with the configuration of the comparative example. A case of printing the image patterns in FIG. 14A and FIG. 14B will be described as an example.

10-1. Description of Image Pattern

An image P is formed on the entire paper width from the thermal history calculating region $CA_3$ to the thermal history calculating region $CA_{12}$ at the edges of A5 size paper. Further, [an image P is formed on the entire paper width from the thermal history calculating region $CA_4$ to the thermal history calculating region $CA_{11}$ at the edges of $A_6$ size paper. In the image P, tertiary colors (cyan (C), magenta (M) and yellow (Y)) of which toner amount equivalent value D (%) is 40% are uniformly formed (maximum toner amount equivalent value $D_{MAX}(i)(\%)=40\%$). The start portion of the image heating portion PR is indicated by PRS, and the end portion is indicated by PRE.

The start portion PRS of the image heating portion PR in Example 3 is set at the upstream side in the transport direction of the recording material from the front end of the image by 5 mm. The end portion PRE of the image heating portion $PR_n$ in Example 3 is set at the downstream side in the transport direction of the recording material from the rear end of the image by 5 mm.

In Example 3, before reaching the start portion PRS of the image heating portion PR, the heater temperature has risen from the control temperature TGT (PP) for the non-image heating portion PP (e.g. intended heating temperature PT=120° C.) to the control temperature TGT ($PR_n$) used for heating the image heating portion $PR_n$.

In Example 3, the above mentioned distance HL (mm), where heating is performed, indicated in FIG. 14A and FIG. 14B, is the total length of the image heating portion $PR_n$ in the recording material transport direction and the distance required for the above mentioned temperature rising. In the image patterns in FIG. 14A and FIG. 14B, it is assumed that the distance HL where heating is performed for the image heating portion PR is the same as the length of the respective paper in the transport direction, and the above mentioned temperature operation starts from the front end of the recording material.

10-2. Description of Comparative Conditions

Using the image patterns in FIG. 14A and FIG. 14B described above, continuous printing is performed. The temperature that is set as the control temperature TGT for each heating region will be compared between Example 3 of the present invention, which is described below, and the comparative example.

10-3. Description of Example 3

The intended heating temperature $FT_n$ for the image heating portion $PR_n$ is corrected in accordance with FIG. 7A to FIG. 7F, using the region heat accumulation amount $HRV_n$ acquired from the above mentioned (Expression 1) and (Expression 2), whereby the control temperature TGT ($A_n$) is determined. As mentioned above, FIG. 7A to FIG. 7F indicate the relationship between the region heat accumulation amount $HRV_n$ and the correction value VA of the intended heating temperature $FT_i$.

First A5 size paper having the image pattern in FIG. 14A is continuously printed, and the paper feeding positions in each thermal history calculating region $CA_1$ to $CA_{14}$ is indicated in FIG. 14A. As illustrated in FIG. 14A, the paper passing width of A5 size paper is 148 mm, which is narrower than the heating region width of the heating regions $A_2$ to $A_6$ (157.2 mm), and is wider than the heating region width of the heating elements $A_3$ to $A_5$ (94.4 mm), which are disposed inside the heating regions $A_2$ to $A_6$. Since the heating region divided positions and the width of the recording material do not match, the paper passing region and the paper unpassing region exist in the heating regions $A_2$ and $A_6$.

As illustrated in FIG. 17A, in the heating region $A_2$, the paper unpassing region and the paper passing region exist in the thermal history calculating region $CA_3$, and the thermal history calculating region $CA_4$ is the paper passing region. In the same manner, in the heating region $A_6$, the paper unpassing region and the paper passing region exist in the thermal history calculating region $CA_{12}$, and the thermal history calculating region $CA_{11}$ is the paper passing region.

Further, as illustrated in FIG. 14B, the paper passing width of $A_6$ size paper is 105 mm, which is narrower than the heating region width of the heating regions $A_2$ to $A_6$ (157.2 mm), and is wider than the heating region width of the heating elements $A_3$ to $A_5$ (94.4 mm), which are disposed inside the heating regions $A_2$ to $A_6$. Since the heating region divided positions and the width of the recording material do not match, the paper passing region and the paper unpassing region exist in the heating regions $A_2$ and $A_6$.

As illustrated in FIG. 17A, in the heating region $A_2$, in the case of $A_6$ size paper, the thermal history calculating region $CA_3$ is the paper unpassing region, and the paper passing region and the paper unpassing region exist in the thermal history calculating region $CA_4$. In the same manner, the thermal history calculating region $CA_{12}$ is the paper unpassing region, and the paper passing region and the paper unpassing region exist in the thermal history calculating region $CA_{11}$.

FIG. 15A and FIG. 15B indicate the region heat accumulation amount $HRV_n$ in each thermal history calculating region $CA_1$ to $CA_{14}$ during continuous printing according to the configuration of Example 3, and the control target temperature ($A_i$) in each heating region $A_1$ to $A_7$ calculated based on the above mentioned flow. FIG. 15A is a state when 53 pages of A5 size paper is continuously printed, and the region heat accumulation amount of the heating region $A_4$ at the center reached 100. FIG. 15B is a state when 74 pages of $A_6$ size paper is continuously printed, and the region heat accumulation amount of the heating region $A_4$ at the center reached 100.

Figure 16A:
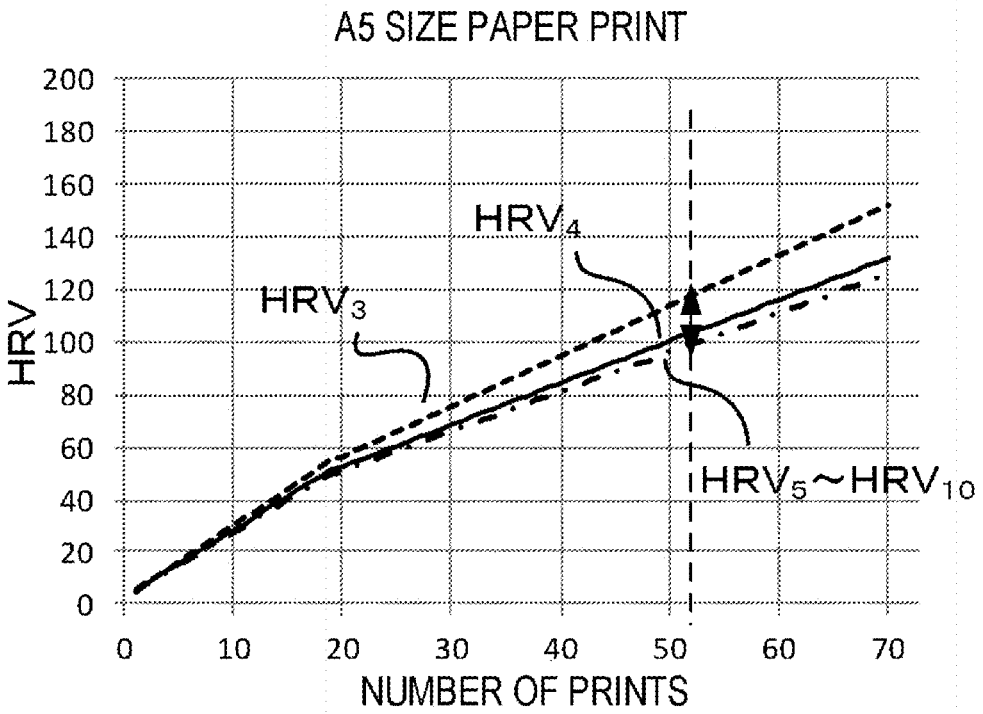
FIG. 16A and FIG. 16B each indicate a graph indicating the transition of the region heat accumulation amount according to Example 3.
Figure 16B:
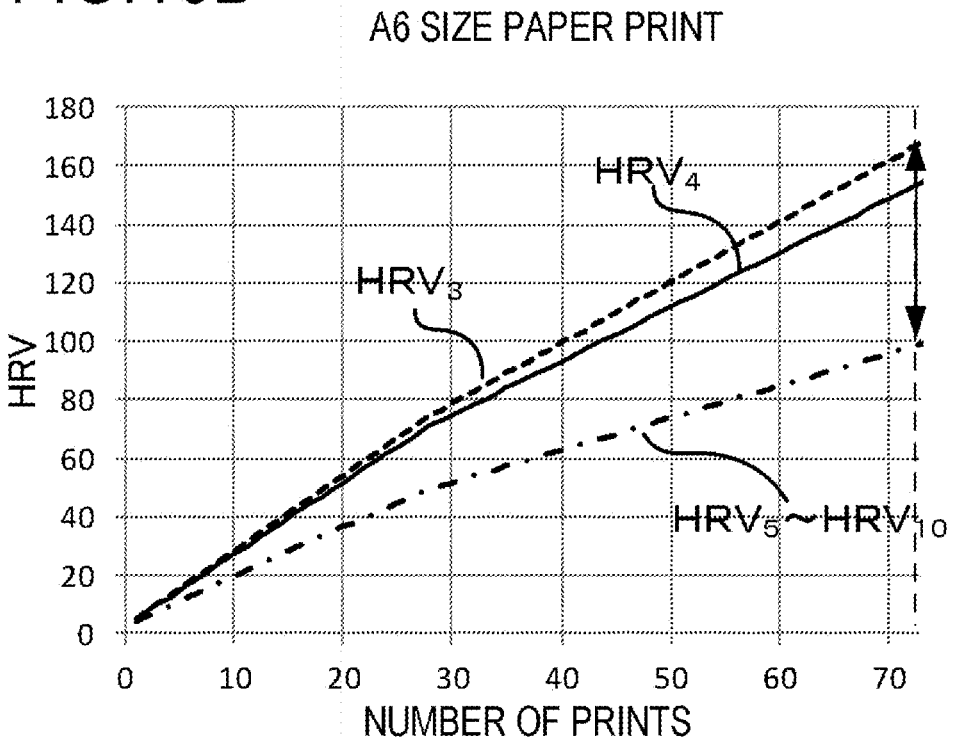

FIG. 16A and FIG. 16B indicate a transitions of the region heat accumulation amount HRV of the thermal history calculating region according to Example 3 when the image patterns in FIG. 14A and FIG. 14B are continuously printed. In the case of A5 paper, a part of the thermal history calculating region $CA_3$ is a paper unpassing region where paper unpassing region temperature rising occurs, but the ratio (percentage) of the paper unpassing region width with respect to the paper passing region width is low, hence temperature does not rise very much.

The heat accumulation amount of the thermal history calculating region $CA_4$, calculated in the configuration of Example 3, also slightly increases, and as indicated in FIG. 15A, the value of the region heat accumulation amount immediately after printing 53 pages is 120 in the case of $HRV_3$, and 105 in the case of $HRV_4$. In other words, the heat accumulation amount increases only slightly compared with the region heat accumulation amount $HRV_5$ in the center region $CA_7$. In the case of $A_6$ size paper, the temperature rising is high, as indicated in FIG. 15B, since the ratio of the paper unpassing region width, with respect to the paper passing region width, is high. The heat accumulation amount in the thermal history calculating region $CA_4$, calculated according to the configuration of Example 3, is higher than that in the thermal history calculating region $CA_7$, which is a paper passing region at the center portion. The thermal history calculating region $CA_3$ is the entire paper unpassing region, where the heat accumulation amount increases even higher than the thermal history calculating region $CA_4$.

Thus the heat accumulation amount becomes much higher in the thermal history calculating region $CA_4$ and the thermal history calculating region $CA_3$ compared with the paper passing regions at the center portion, such as the thermal history calculating region $CA_7$, and the values of the region heat accumulation amount immediately after printing 74 pages becomes 170 in the case of $HRV_3$, and 155 in the case of $CT_4$.

As described above, according to Example 3, the thermal history calculating regions are set by dividing the thermal regions, then the region heat accumulation amount $CT_n$ is calculated in accordance with the widths of the paper passing region and the paper unpassing region using Expression 5, and the influence of the widths is reflected in the region heat accumulation amount HRV of the paper passing region. Therefore, as indicated in FIG. 15B, in the case of $A_6$ size paper, the control target temperature of the heating regions $A_2$ and $A_3$, where the edge of the recording material passes, is set to TGT=178° C., which is lower than those of the heating regions $A_3$ to $A_5$ at the center portion of the recording material.

Further, as indicated in FIG. 15A, in the case of A5 size paper, the paper unpassing portion temperature rising is low, since the ratio of the paper unpassing region with respect to the heating region $A_2$ is smaller compared with $A_6$ size paper. By reflecting the influence of the widths in the region heat accumulation amount HRV of the paper passing region, the control target temperature of the heating regions $A_2$ and $A_6$, where the edge of the recording material passes, is set to TGT=183° C., which is the same as those of the heating regions $A_3$ to $A_5$ at the center portion of the recording material.

In this way, according to Example 3, the region heat accumulation amount is calculated, in accordance with the widths of the paper passing region and the paper unpassing region, and the influence of the widths, is reflected in the region heat accumulation amount HRV of the paper passing region, hence the correction can be performed in accordance with the paper unpassing portion temperature rising.

10-4. Description of Comparative Example

In the comparative example, the predicted heat accumulation amount is calculated for each heating region, and the intended heating temperature $FT_i$ for the image heating portion $PR_i$ is corrected based on this predicted heat accumulation amount, whereby the control temperature TGT ($PR_i$) is determined, as described in the comparative example of Example 1.

10-5. Comparison of Example 3 and Comparative Example

The control temperature TGT, in the case of continuously printing $A_6$ size paper having the image pattern in FIG. 14B according to the comparative example, will be described. In the comparative example, the temperature state of the paper unpassing portion cannot be reflected, since the heat accumulation state is calculated regarding the heating region $A_2$, where the edge of the recording material passes, as one paper passing region. Therefore [the control target temperature of the heating region $A_i$ is set to TGT ($A_1$)=183° C., which is the same as those of the heating regions $A_3$ to $A_5$ at the center portion of the recording material. As mentioned above, according to Example 3, the thermal history calculating regions are set by dividing the heating region, then the region heat accumulation amount of the paper unpassing region is calculated, and the influence of this value is reflected in the region heat accumulation amount HRV of the paper passing range. Therefore as indicated in FIG. 15B, the control target temperature of the heating region $A_2$, where the edge of the recording material passes, is set to TGT ($A_2$)=178° C., which is lower than those of the heating regions $A_3$ to $A_5$ at the center portion of the recording material.

Figure 17B:
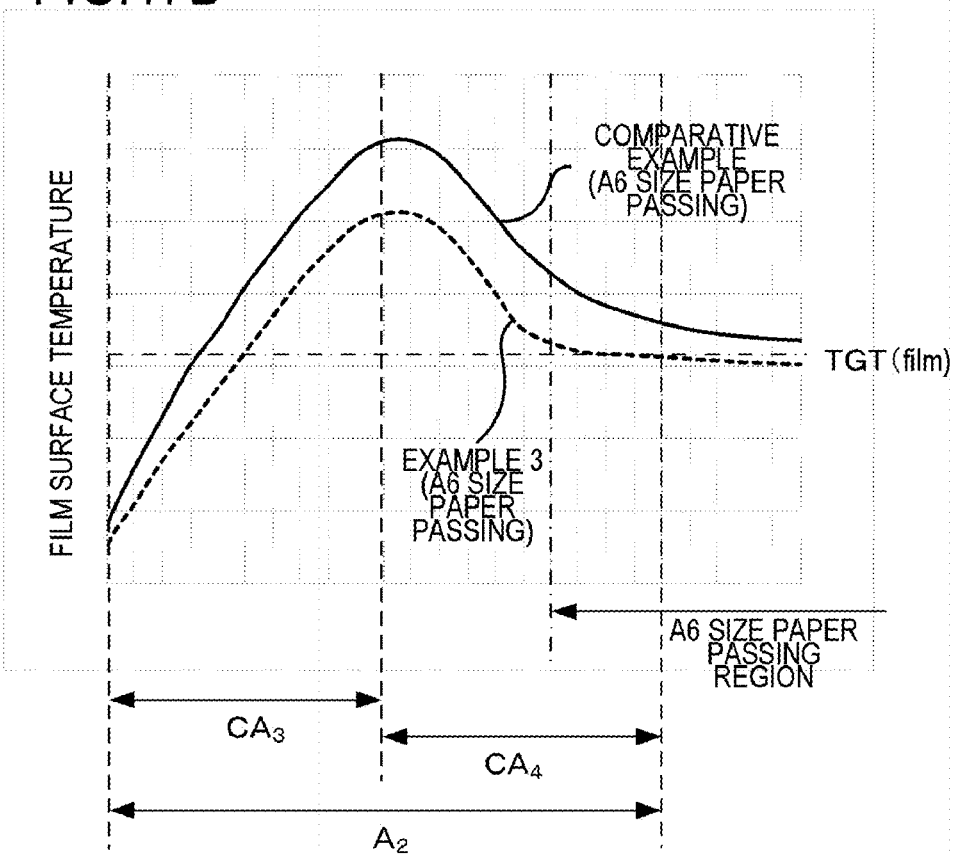

FIG. 17B indicates a fixing film surface temperature distribution in the vicinity of the heating region $A_2$ when $A_6$ size paper is continuously printed according to Example 3 and the comparative example. As indicated in FIG. 17B, the temperature rises in the paper unpassing region of $A_6$ size paper since heat is not transferred to the recording material. Therefore the heat is transferred from the paper unpassing region to the paper passing region, and the film surface temperature of the edge region of $A_6$ size paper considerably rises from the control target temperature TGT (film) of the film. In the case of the configuration of Example 3, on the other hand, the heat accumulation amount in the regions $CA_3$ and $CA_4$, where the paper unpassing region temperature rising is occurring, is calculated, and the result is reflected in the control temperature setting of the paper passing portion, hence the paper unpassing temperature rising is reduced, and the film temperature rising in the edge region of $A_6$ size paper can be suppressed.

In the case of the comparative example, excessive heat is supplied to the image heating regions at the edge of the recording material, more than a heat amount that is actually required. This results in the generation of a hot offset, that is, the image P toner adheres to the surface of the fixing film 202 due to overheating, and this adhering toner attaches to the recording material after one rotation. Unnecessary power is consumed due to this amount of high temperature setting, which diminishes the power saving performance.

In the case of Example 3, a region heated by one heating element is divided into a plurality of heating regions, then the thermal history of each heating region is calculated, and the heat accumulation amount is predicted considering the influence of the thermal history of the adjacent heating regions. Further, the region heat accumulation amount HRV is calculated in accordance with the widths of the paper passing region and the paper unpassing region, whereby the correction is performed. As a consequence, a value closer to the actual heat accumulation amount can be predicted more accurately than the comparative example.

In Example 3, a case of using A5 and A6 size paper was described as an example, but the effect can be implemented for other recording material sizes as well. Further, in Example 3, correction is performed in accordance with the ratio of passing width of the paper passing portion and the paper unpassing portion, therefore the effect can be implemented for various sizes of recording materials, regardless the divided positions of the thermal history calculating regions to calculate the heat accumulation amount.

In Examples 1 to 3, the control target temperature for the image heating region is adjusted in accordance with the predicted heat accumulation amount of each region, but another means of adjusting the heating amount of the recording material P may be used. For example, the amount of power to be supplied to the heater may be adjusted in accordance with the predicted heat accumulation amount of each heating region. In other words, instead of adjusting the power supply amount so that the temperature detected by the thermistor becomes a predetermined control target temperature, the power supply amount is set in advance for each control condition parameter, including the predicted heat accumulation amount, and the power amount is adjusted in accordance with the change in the parameters. Further, in the description of the examples, the control temperature is used as the thermal history, which is referred to in order to predict the heat accumulation amount, but the power supplied to the heater may be referred to so that the heat accumulation amount is predicted based on this power amount. In the examples, the region heat accumulation amount HRV is acquired (updated) as the predicted heat accumulation amount for each page, that is, each time one recording material passes the fixing portion, but the update may be performed at a every predetermined number of pages.

To simplify description, in Example 1, the correction based on the region heat accumulation amount $HRV_i$ is not performed for the non-image heating portion PP and the paper unpassing portion NP. However, the correction based on the region heat accumulation amount $HRV_i$ may be performed for these portions as well, so as to further save power.

Each configuration of the above described examples may be combined as much as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-096656, filed on May 18, 2018, which is hereby incorporated by reference herein in its entirety.

What is claimed is:

1. An image forming apparatus comprising:

a fixing portion which includes a plurality of heating elements disposed in a direction orthogonal to a transport direction of a recording material, and heats a plurality of heating regions independently by the plurality of heating elements respectively, so as to fix an image formed on a recording material to the recording material;

an acquiring portion which acquires (i) information on an image formed on a recording material, and (ii) thermal history information on a plurality of regions of a constituting member of the fixing portion, corresponding to the plurality of heating regions respectively; and a control portion which controls heating of the plurality of heating regions by the fixing portion such that each temperature of the plurality of heating regions is individually controlled, wherein each of the plurality of heating regions is divided in a direction orthogonal to the transport direction into a plurality of thermal history calculating region, and the acquiring portion acquires thermal history information on a region of the constituting member corresponding to the thermal history calculating region, wherein the control portion corrects a control setting used for a temperature control of the plurality of heating regions, based on the thermal history information on the region of the constituting member corresponding to the thermal history calculating region, and wherein the thermal history information is acquired based on at least a heating history and a heat radiating history of a region of the constituting member corresponding to the thermal history calculating region.

2. An image forming apparatus comprising:

a fixing portion which includes a plurality of heating elements disposed in a direction orthogonal to a transport direction of a recording material, and heats a plurality of heating regions independently by the plurality of heating elements respectively, so as to fix an image formed on a recording material to the recording material;

an acquiring portion which acquires (i) information on an image formed on a recording material, and (ii) thermal history information on a plurality of regions of a constituting member of the fixing portion, corresponding to the plurality of heating regions respectively; and a control portion which controls each temperature of the plurality of heating regions independently, wherein each of the plurality of heating regions is divided in a direction orthogonal to the transport direction into a plurality of thermal history calculating region, and the acquiring portion acquires (iii) thermal history information of a region of the constituting member corresponding to the thermal history calculating region, and (iv) a ratio of a paper passing region and a no paper passing region in the thermal history calculating region, wherein the control portion corrects a control setting used for the temperature control of the plurality of heating regions, based on (iii) the thermal history information of a region of the constituting member corresponding to the thermal history calculating region, and (iv) the ratio of a paper passing region and a no paper passing region in the thermal history calculating region, and wherein the thermal history information is acquired based on at least a heating history and a heat radiating history of a region of the constituting member corresponding to the thermal history calculating region.

3. The image forming apparatus according to claim 1, wherein when one thermal history calculating region has an adjacent thermal history calculating region on each side thereof, the control portion corrects the control setting based on the thermal history information on each region of the constituting member corresponding to both of the adjustment thermal history calculating regions, and the thermal history information on a region of the constituting member corresponding to the one thermal history calculating region.

4. The image forming apparatus according to claim 1, wherein the control setting is a control target temperature of the heating region.

5. The image forming apparatus according to claim 1, wherein the fixing portion includes a heater constituted of the plurality of heating elements and a substrate on which the plurality of heating elements are disposed, and fixes an image formed on a recording material to the recording material using the heat of the heater, wherein the control portion controls power to be supplied to the plurality of heating elements independently, wherein the constituting member includes at least the heater, wherein a region of the constituting member corresponding to the heating region is a region corresponding to each of the plurality of heating elements in the heater, wherein the thermal history information includes at least one of a temperature history of the heater and a history of power supplied to the heating elements as the heating history, and includes at least a period when power is not supplied to the heating elements as the heat radiating history.

6. The image forming apparatus according to claim 5, wherein the fixing portion further includes a tubular film of which inner surface is contacted by the heater, and a pressure member which contacts the outer surface of the film, and forms a nip portion with the outer surface so as to transport the recording material, wherein the constituting member includes the film and the pressure member, wherein a region of the constituting member corresponding to the heating region is a region corresponding to each of the plurality of heating elements in the nip portion, wherein the thermal history information includes at least a period of the image on the recording material passing the nip portion being heated by the fixing portion while the fixing portion is in a state of being able to transport the recording material by the nip portion, as the heating history, and includes at least one of a period of the recording material passing through the nip portion, and a period of the recording material not passing through the nip portion, while the fixing portion is in a state of being able to transport the recording material by the nip portion, as the heat radiating history.

* * * * *